US006851553B2

(12) United States Patent
Venable et al.

(10) Patent No.: US 6,851,553 B2
(45) Date of Patent: Feb. 8, 2005

(54) CIGARETTE CARTON WITH DISPENSING PORTION

(76) Inventors: Mitchell A. Venable, 8675 Red Bank Rd., Germanton, NC (US) 27019; Karen Marie Keith, 1220 Barksdale Rd., Lewisville, NC (US) 27023

( * ) Notice: Subject to any disclaimer, the term of this patent is extended or adjusted under 35 U.S.C. 154(b) by 214 days.

(21) Appl. No.: 10/324,886

(22) Filed: Dec. 20, 2002

(65) Prior Publication Data

US 2003/0136688 A1 Jul. 24, 2003

Related U.S. Application Data

(63) Continuation-in-part of application No. 09/740,236, filed on Dec. 18, 2000, now abandoned.

(51) Int. Cl.[7] ..... A24F 15/00

(52) U.S. Cl. ..... 206/273; 206/271; 229/122; 229/122.1; 221/305

(58) Field of Search ..... 229/122, 122.21, 229/122.1, 120, 210; 206/242, 271, 273, 206; 221/305

(56) References Cited

U.S. PATENT DOCUMENTS

| | | | |
|---|---|---|---|
| 214,867 | A | 4/1879 | Arnold |
| 902,347 | A | 10/1908 | Tillinghast |
| 1,408,752 | A | 3/1922 | List |
| 1,585,494 | A | 5/1926 | Harvey |
| 2,771,988 | A | 11/1956 | Sweeney |
| 2,875,938 | A | 3/1959 | Bramhill |
| 3,101,884 | A | 8/1963 | Price |
| 3,286,830 | A | 11/1966 | Robb, Jr. |
| 3,568,883 | A | 3/1971 | Reynolds |
| 3,809,227 | A | 5/1974 | Begemann |
| 3,960,270 | A | 6/1976 | May |
| 4,138,052 | A | 2/1979 | Torigian |
| 4,405,044 | A | 9/1983 | Flower et al. |
| 4,534,463 | A | 8/1985 | Bouchard |
| 4,566,607 | A | 1/1986 | Smith |
| 4,784,261 | A | 11/1988 | Kutchin |
| 4,928,817 | A | 5/1990 | Focke |
| 4,949,845 | A | 8/1990 | Dixon |
| 5,020,670 | A | 6/1991 | Bedford |
| 5,074,462 | A | 12/1991 | Countee, Jr. |
| 5,147,037 | A | 9/1992 | Evers et al. |
| 5,158,178 | A | 10/1992 | Cobler |
| 5,160,024 | A | 11/1992 | Evers |
| 5,193,674 | A | 3/1993 | Cobler et al. |
| 5,205,403 | A | 4/1993 | DeBlasio |
| 5,370,220 | A | 12/1994 | Wang |
| 5,460,322 | A | 10/1995 | Carlson et al. |
| 5,503,268 | A | 4/1996 | Pham |
| 5,927,495 | A | 7/1999 | Didiano, Jr. |
| 6,050,402 | A | 4/2000 | Walter |
| 6,155,480 | A | 12/2000 | Botsford et al. |
| 2002/0185499 | A1 | 12/2002 | Harrelson et al. |

OTHER PUBLICATIONS

Innovation & Development, Inc.; Gravity Feed Dispenser Carton.

*Primary Examiner*—David T. Fidei
(74) *Attorney, Agent, or Firm*—Kilpatrick Stockton LLP

(57) ABSTRACT

A carton assembly for packages of smoking articles comprises a top wall, a bottom wall, a first side wall, a second side wall, a first end wall, a second end wall and a dispensing portion. The dispensing portion is defined by a perforation line on the first and second side walls and the bottom wall before the dispensing portion is removed. When the perforation line is torn, the dispensing portion may be removed allowing cigarette packages to be withdrawn from the carton assembly.

43 Claims, 16 Drawing Sheets

CIGARETTE CARTON WITH DISPENSING PORTION

CROSS REFERENCE TO RELATED APPLICATIONS

This patent application is a continuation-in-part application of, and claims priority to, pending U.S. patent application Ser. No. 09/740,236, filed on Dec. 18, 2000, now abandoned, which is hereby incorporated herein by reference in its entirety.

FIELD OF THE INVENTION

The present invention relates to the packaging of smoking articles such as cigarettes into cartons, and in particular, to a cigarette carton assembly having a dispensing portion.

BACKGROUND OF THE INVENTION

It is common practice to ship and store cigarette packages in cartons. Conventional or standard cigarette cartons ordinarily hold ten packages, each package containing about 20 cigarettes. The packages are usually arranged in two relatively superposed rows of 5 packages each. Such standard cartons completely encase the cigarette packages and are provided with glued flaps. Examples of cartons for ten packages of cigarettes are provided in U.S. Pat. Nos. 3,752,308 to Begemann; 4,738,359 to Phillips, Jr.; and 4,903,844 to Oglesby.

Cigarette packages are normally removed from a carton by opening a top portion of the carton, which extends the length of the carton and exposes the bottom of the cigarette packages when opened, and removing the packages as needed. One problem with removing cigarette packages from the top of the carton is that all of the cigarette packages can fall out of the carton if it is knocked over.

Previous cartons have included ways to remove cigarette packages other than opening the top portion. For example, U.S. Pat. No. 2,875,938 issued to Bramhill shows a cigarette carton having an opening for the removal of cigarettes. Bramhill only discloses a cigarette carton where the cigarette packages are arranged in a single row of eight packages. In addition, the top flap of the carton disclosed by Bramhill opens only to expose the side faces of the cigarette packages. Thus, when cigarette packages are arranged in the carton of Bramhill, the ends of the packages could not be tax stamped while in the carton using modern tax stamping equipment.

U.S. Pat. No. 2,771,988 issued to Sweeney shows a cigarette carton that can be converted into a gravity fed receptacle for mounting. To remove a cigarette package from the carton of Sweeney, a person must push the packages out of the carton by inserting a finger or thumb in an opening on the opposite side. One disadvantage of the carton of Sweeney is that the carton must be placed in a location where a person has access to the back of it in order to push the cigarettes out.

Another patent illustrating a carton which allows for the removal of cigarette packages without opening the top portion is U.S. Pat. No. 6,050,402 issued to Walter. Walter discloses a carton that contains ten packages of cigarettes arranged in a face to face stack. A dispensing portion is shown for the removal of cigarette packages. The width of the dispensing portion is equal to the depth of the cigarette package such that the cigarette packages are removed sideways. One disadvantage of Walter is that the carton is designed to hold ten cigarette packages arranged in a face to face stack. This ten by one arrangement would make it difficult to implement the Walter patent in conventional cigarette production processes, particularly with regard to the tax stamping of cigarette packages.

The present invention addresses these problems by providing a carton assembly with a dispensing portion that enables the removal of individual cigarette packages. The dispensing portion may be removed from the carton allowing for the withdrawal of cigarette packages. Carton assemblies of the present invention containing cigarette packages may be tax stamped using conventional tax stamping machines and may be produced without changing print cylinders.

SUMMARY OF THE INVENTION

The present invention relates to carton assemblies for cigarette packages. One carton assembly of the present invention comprises a parallelepiped comprising a top wall, a bottom wall opposite the top wall, a first side wall, a second side wall opposite the first side wall, a first end wall, a second end wall opposite the first end wall, and a dispensing portion. Each side wall has a top edge, a bottom edge, and two end edges. The first end wall is positioned between the first end edge of the first side wall and the first end edge of the second side wall. The second end wall is positioned between the second end edge of the first side wall and the second end edge of the second side wall. The top wall is positioned between the top edge of the first side wall and the top edge of the second side wall. The bottom wall is positioned between the bottom edge of the first side wall and the bottom edge of the second side wall.

In one embodiment, the dispensing portion, before it is removed, is defined by an end edge of the bottom wall and a perforation line extending from the first side wall, across the bottom wall, and onto the second side wall. In a further embodiment, the perforation line preferably extends from the first side wall, across the bottom edge of the first side wall, across the bottom wall, across the bottom edge of the second side wall, and onto the second side wall.

In another embodiment with the perforation line having portions on the first side wall, the bottom wall, and the second side wall, the perforation line comprises a first arcuate region on the first side wall and a second arcuate region on the second side wall. In a further embodiment, the perforation line begins at a first corner (formed at the intersection of the bottom edge of the first side wall and the second end edge of the first side wall); extends from the first corner along a portion of the second end edge of the first side wall, onto the first side wall, across the bottom edge of the first side wall, across the bottom wall, across the bottom edge of the second side wall, onto the second wall, and along a portion of the second end edge of the second side wall; and terminates at a second corner (formed at the intersection of the bottom edge of the second side wall and the second end edge of the second side wall).

The dispensing portion may be removed to allow for the removal of cigarette packages from the cigarette carton assembly. The carton assembly may be vertically positioned on a flat surface to provide for the easy removal of cigarette packages. With the carton assembly vertically oriented, the cigarette packages are gravity fed to the opening where the dispensing portion was removed.

In another embodiment, a cigarette carton assembly comprises a parallelepiped having (1) a first side wall having a top edge, a bottom edge, a first end edge, and a second end edge; (2) a second side wall opposite the first side wall and having a top edge, a bottom edge, a first end edge, and a second end edge; (3) a first end wall positioned between the first end edge of the first side wall and the first end edge of the second side wall; (4) a second end wall opposite the first end wall and positioned between the second end edge of the first side wall and the second end edge of the second side wall; (5) a top wall positioned between the top edge of the first side wall and the top edge of the second side wall; and (6) a bottom wall having two end edges, opposite the top wall and positioned between the bottom edge of the first side wall and the bottom edge of the second side wall. The bottom edge of the first side wall and the second end edge of the first side wall intersect to form a first corner and the bottom edge of the second side wall and the second end edge of the second side wall intersect to form a second corner. This embodiment of a cigarette carton assembly further comprises a removable dispensing portion defined by a first end edge of the bottom wall and a perforation line, the perforation line having two ends and having portions on the first side wall, the bottom wall, and the second side wall. The perforation line may extend from the first corner onto the first side wall, across the bottom edge of the first side wall, across the bottom wall, across the bottom edge of the second side wall, and onto the second wall, and may terminate at the second corner.

In another embodiment, a cigarette carton assembly may comprise a parallelepiped comprising: (1) a first side wall having a top edge, a bottom edge, a first end edge, and a second end edge; (2) a second side wall opposite the first side wall and having a top edge, a bottom edge, a first end edge, and a second end edge; (3) a first end wall positioned between the first end edge of the first side wall and the first end edge of the second side wall; (4) a second end wall opposite the first end wall and positioned between the second end edge of the first side wall and the second end edge of the second side wall; (5) a top wall positioned between the top edge of the first side wall and the top edge of the second side wall; and a bottom wall having two end edges, opposite the top wall and positioned between the bottom edge of the first side wall and the bottom edge of the second side wall. The carton assembly further comprises a dispensing portion, which is defined by a first end edge of the bottom wall, a perforation line having portions on the first side wall and the bottom wall, and a score line on the second side wall. The perforation line extends from the second end edge of the first side wall, onto the first side wall, across the bottom edge of the first side wall, across the bottom wall, and terminates at the bottom edge of the second side wall. The score line extends from the bottom edge of the second side wall, across the second side wall, and terminates at the second end edge of the second side wall. In another embodiment, the cigarette carton assembly further comprises a second perforation line. The second perforation line is aligned with the score line, in another embodiment, and both the score line and the second perforation line may be semi-circular.

It is a feature and advantage of the present invention to provide a carton assembly for cigarette packages that includes a dispensing portion for the easy removal of cigarette packages from the carton.

It is a further feature and advantage of the present invention to provide a carton assembly that includes a gravity fed dispensing portion for cigarette packages.

Another advantage of the present invention is to provide a carton assembly for cigarette packages that allows individual cigarette packages to be removed without opening the entire carton assembly.

A still further feature and advantage of the present invention is to provide a carton assembly that by allowing individual cigarette packages to be removed without opening the entire carton assembly, prevents all of the cigarette packages from falling out of the carton at once.

The present invention also advantageously provides a carton assembly that includes a removable dispensing portion.

Another advantage of the present invention is to provide a carton assembly that may be produced on conventional carton manufacturing equipment with minimal modifications.

A further advantage of the present invention is to provide a carton assembly having a dispensing portion that may be opened like a conventional carton assembly by not removing the dispensing portion.

A still further advantage of the present invention is to provide a carton assembly that when filled with cigarette packages can be passed through a conventional tax stamping machine.

With the foregoing and other advantages and features of the invention that will become hereinafter apparent, the nature of the invention may be more clearly understood by reference to the following detailed description of the invention, the appended claims and to the several views illustrated in the drawings.

DETAILED DESCRIPTION OF THE INVENTION

Figure 1:
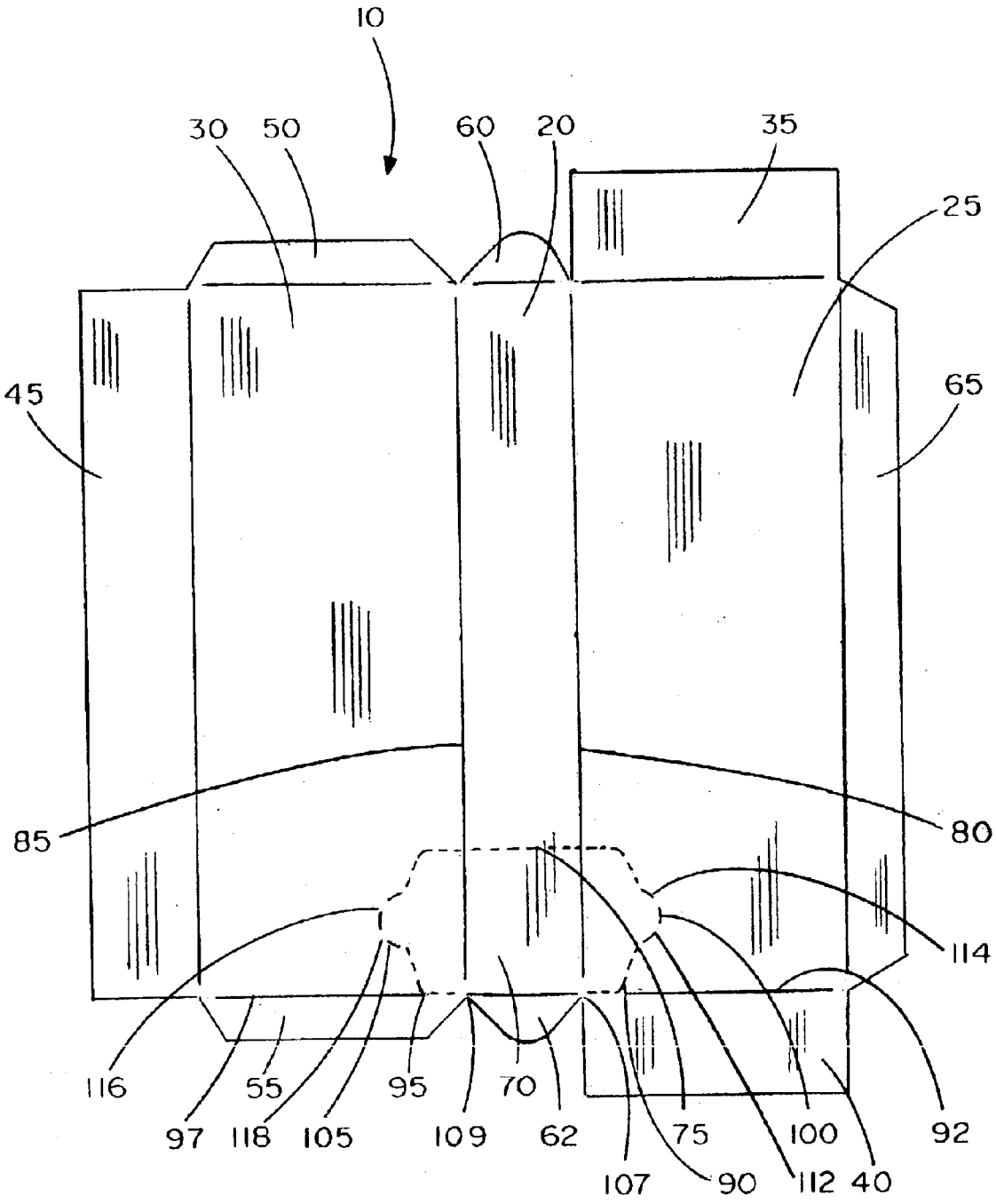
FIG. 1 is a top plan view of an embodiment of a blank portion for making a carton assembly according to the present invention.

The present invention relates to the packaging of smoking articles such as cigarettes into cartons, and in particular, to a cigarette carton having a dispensing portion. One carton assembly of the present invention for a plurality of cigarette packages comprises a parallelepiped comprising a top wall, a bottom wall opposite the top wall, a first side wall, a second side wall opposite the first side wall, a first end wall, a second end wall opposite the first end wall, and a dispensing portion. Each side wall has a top edge, a bottom edge, and two end edges. The first end wall is positioned between the first end edge of the first side wall and the first end edge of the second side wall. The second end wall is positioned between the second end edge of the first side wall and the second end edge of the second side wall. The top wall is positioned between the top edge of the first side wall and the top edge of the second side wall. The bottom wall is positioned between the bottom edge of the first side wall and the bottom edge of the second side wall.

In one embodiment, the dispensing portion, before it is removed from the carton assembly, is preferably defined by an end edge of the bottom wall and a perforation line extending from the first side wall, across the bottom wall, and onto the second side wall. In a further embodiment, the perforation line preferably extends from the first side wall, across the bottom edge of the first side wall, across the bottom wall, across the bottom edge of the second side wall, and onto the second side wall. A first end of the perforation line terminates at an edge of the first side wall where the first side wall and the second end wall intersect. A second end of the perforation line terminates at an edge of the second side wall where the second side wall and the second end wall overlap.

In one embodiment with the perforation line having portions on the first side wall, the bottom wall, and the second side wall, the perforation line comprises a first arcuate region on the first side wall and a second arcuate region on the second side wall. In a further embodiment, the perforation line begins at a first corner (formed at the intersection of the bottom edge of the first side wall and the second end edge of the first side wall); extends from the first corner along a portion of the second end edge of the first side wall, onto the first side wall, across the bottom edge of the first side wall, across the bottom wall, across the bottom edge of the second side wall, onto the second wall, and along a portion of the second end edge of the second side wall; and terminates at a second corner (formed at the intersection of the bottom edge of the second side wall and the second end edge of the second side wall).

In another embodiment, a cigarette carton assembly comprises a parallelepiped having (1) a first side wall having a top edge, a bottom edge, a first end edge, and a second end edge; (2) a second side wall opposite the first side wall and having a top edge, a bottom edge, a first end edge, and a second end edge; (3) a first end wall positioned between the first end edge of the first side wall and the first end edge of the second side wall; (4) a second end wall opposite the first end wall and positioned between the second end edge of the first side wall and the second end edge of the second side wall; (5) a top wall positioned between the top edge of the first side wall and the top edge of the second side wall; and (6) a bottom wall having two end edges, opposite the top wall and positioned between the bottom edge of the first side wall and the bottom edge of the second side wall. The bottom edge of the first side wall and the second end edge of the first side wall intersect to form a first corner and the bottom edge of the second side wall and the second end edge of the second side wall intersect to form a second corner. This embodiment of a cigarette carton assembly further comprises a removable dispensing portion defined by a first end edge of the bottom wall and a perforation line, the perforation line having two ends and having portions on the first side wall, the bottom wall, and the second side wall. The perforation line may extend from the first corner onto the first side wall, across the bottom edge of the first side wall, across the bottom wall, across the bottom edge of the second side wall, and onto the second wall, and may terminate at the second corner. In one embodiment, the perforation line may comprise a plurality of angled cuts. The perforation line may further comprise a tear start region on the first side wall. In another embodiment, the perforation line may be a zipper-type perforation line.

Carton assemblies of the present invention can hold any number of cigarette packages. Standard cigarette carton assemblies contain ten cigarette packages in a two by five configuration. Thus, in a further embodiment, a carton assembly of the present invention contains ten cigarette packages. While the figures contained herein illustrate cigarette carton assemblies designed to contain ten cigarette packages, other embodiments of carton assemblies of the present invention may contain, for example, five cigarette packages (in a one by five configuration) or eight cigarette packages (in a two by four configuration).

Referring now in detail to the drawings, FIG. 1 is a top plan view of an embodiment of a blank portion 10 for making a carton assembly according to the present invention. The blank portion 10 is designed to form an assembled "standard" carton for ten cigarette packages arranged in a two by five configuration. As noted above, other blank portions for making carton assemblies according to the present invention may be designed to hold any number of cigarette packages.

The blank portion 10 most preferably is provided from paperboard sheet, and includes a plurality of fold lines, creases or score lines (shown as solid lines in FIG. 1), perforations, cuts or slits (shown as dotted lines in FIG. 1). The degree of perforation can vary, and can be provided as desired. However, the degree of perforation is such that the dispensing portion 70 does not easily tear. The cuts conveniently are made by slitting the blanks without necessarily removing material therefrom. The folds, perforations and cuts of the blank portion define panels which correspond to walls, portions, sides and flaps of the carton assembly, which ultimately is constructed from the blank portion 10.

Figure 2:
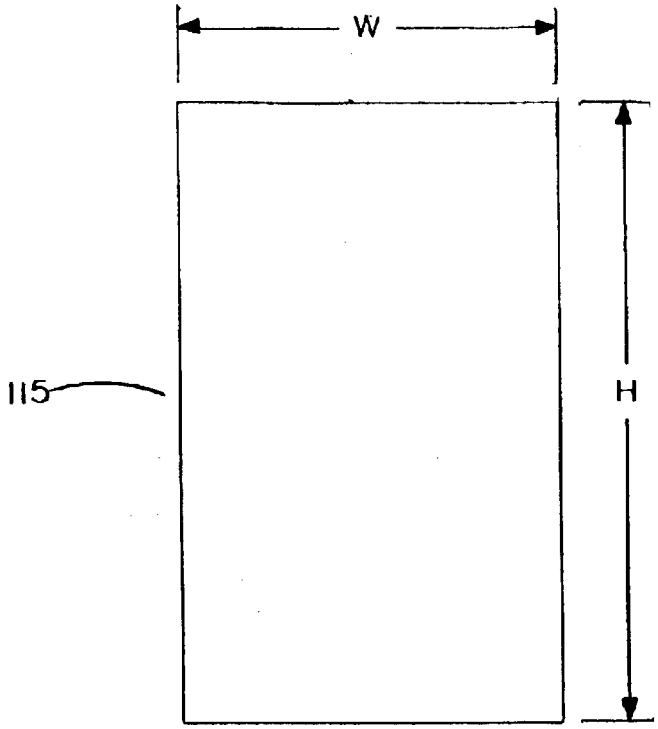
FIG. 2 is a side elevational view of a typical cigarette package.
Figure 3:
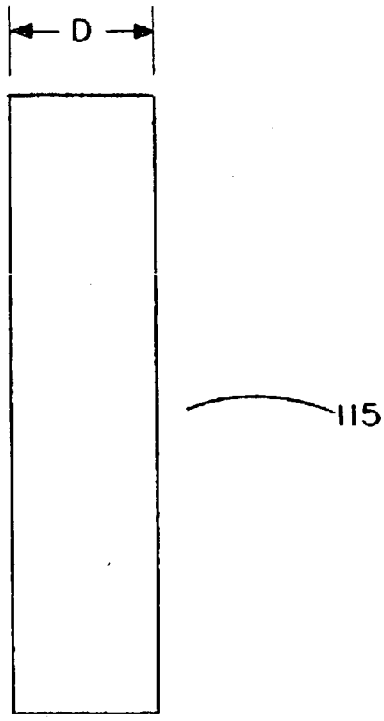
FIG. 3 is another side elevational view of a typical cigarette package.

The blank portion 10 includes a bottom wall 20 corresponding to the bottom of the carton assembly, a first side wall 25, a second side wall 30, a first end wall 35 positioned integral with and at one end of the first side wall 25 and a second end wall 40 positioned integral with and at the other end of the first side wall. The length of the first side wall 25 is preferably equal to the width of five cigarette packages. FIGS. 2 and 3 are elevational views of a typical cigarette package 115 illustrating what is meant by the height (H), width (W) and depth (D) of a cigarette package. The length of the second side wall 30 also is essentially equal to the width of five cigarette packages. The width of each side wall 25, 30 is equal to the height of a cigarette package. The width of the bottom wall 20 is essentially equal to the depth of two cigarette packages. The dimensions of the carton assembly may vary depending on the size of the cigarette packages. For example, a cigarette package containing 100 mm cigarettes would require a side wall with a greater width (i.e., a taller cigarette carton assembly) than a cigarette package containing 85 mm cigarettes.

The blank portion 10 also includes a first end flap 50 integral with and at one end of second side wall 30, a second end flap 55 integral with and at the other end of second side wall 30, and reinforcing tabs 60,62 integral with and at the ends of the bottom wall 20. While the first reinforcing tab 60 may be optional, a preferred embodiment of the present invention includes both reinforcing tabs 60,62. The second reinforcing tab 62 is positioned near the dispensing portion 70. The blank portion 10 also includes a top flap 65 integral with and to one side of the first side wall 25 and a top wall 45 integral with and to one side of the second side wall 30.

When assembled, the top wall 45 overlaps the top flap 65 to form the top of the carton. The first end wall 35 overlaps the first end flap 50 and the first reinforcing tab 60 while the second end wall 40 overlaps the second end flap 55 and the second reinforcing tab 62.

FIG. 1 also shows the dispensing portion 70. The dispensing portion 70 is preferably removable. Before the dispensing portion 70 is removed, it comprises a perforation line 75 on the first and second side wall 25,30 and the bottom wall 20. The perforation line 75 extends from the first side wall 25, across a first edge 80 at the intersection of the bottom wall 20 and the first side wall 25, across the width of the bottom wall 20, across a second edge 85 at the intersection of the bottom wall 20 and the second side wall 30, and onto the second side wall 30. Aside from the arcuate regions 100,105 which are preferably cut (as discussed below), the perforation line, in one embodiment, comprises two millimeter (2 mm) perforations with one and a half millimeter (1.5 mm) perforation gaps.

The first end 107 of the perforation line 75 terminates at an edge 92 of the first side wall 25 (i.e., the intersection of the first side wall 25 and the second end wall 40). As shown in FIG. 1, the first end 107 of the perforation line 75 preferably terminates at the corner where the first side wall 25, the second end wall 40 and the bottom wall 40 intersect. The second end 109 of the perforation line 75 terminates at an edge 97 of the second side wall 30 (i.e., the intersection of the second side wall 30 and the second end flap 55). As shown in FIG. 1, the second end 109 of the perforation line 75 preferably terminates at the corner where the second side wall 30, the second end flap 55 and the bottom wall 20 intersect.

The perforation line 75 also preferably includes arcuate regions 100,105 on each of the side walls 25,30. The arcuate regions 100,105 are preferably the approximate width of an adult's finger, such that the perforation line 75 can be readily torn to open the dispensing portion 70. Instead of the arcuate regions 100,105 shown in FIG. 1, other shapes, such as square tab regions, could be used to assist in opening the dispensing portion 70. However, the dispensing portion is more easily opened with arcuate regions as they have no corners. In addition, rather than being perforated, the two arcuate regions 100,105 are preferably cut leaving two ticks 112,114,116,118 per arcuate region 100,105 that connect the arcuate regions 100,105 to the remainder of the carton 10. This assists in the removal of the dispensing portion 70 through the arcuate regions 100,105.

When the blank portion is assembled into a carton assembly as shown in FIGS. 4–16, the carton preferably holds 10 cigarette packages, arranged or positioned in a standard two by five configuration. That is, five packages are positioned side-by-side in a row on the first side portion, and five packages are positioned side-by-side on the second side portion of the carton. The length of the assembled carton is, thus, preferably equal to the width of five packages of cigarettes. The height of the assembled carton is preferably equal to the height of a cigarette package and the depth of the assembled carton is preferably equal to the depth of two cigarette packages. As noted above, while FIGS. 4–16 illustrate a standard cigarette carton assembly designed to contain ten cigarette packages, other embodiments of carton assemblies of the present invention may contain, for example, five cigarette packages (in a one by five configuration) or eight cigarette packages (in a two by four configuration).

Figure 4:
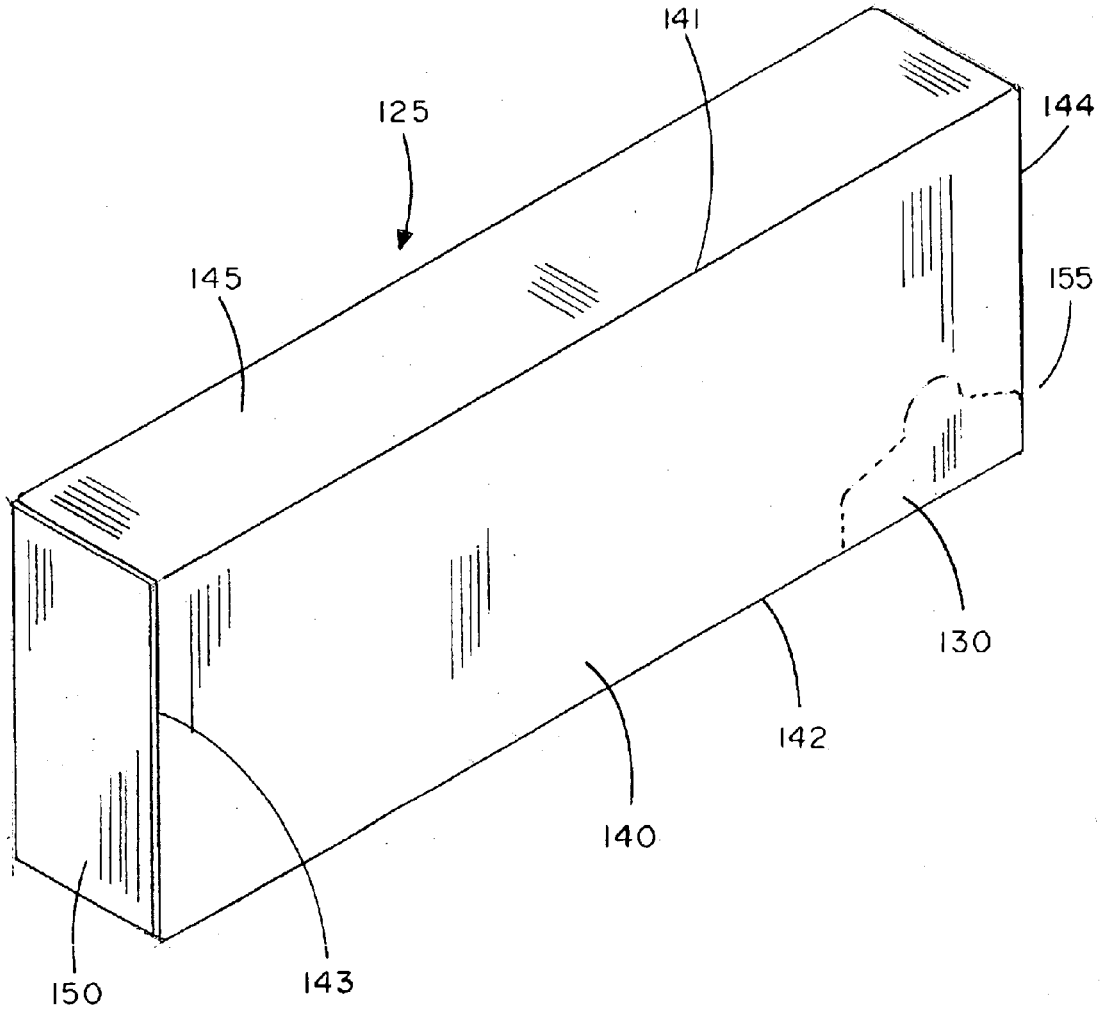
FIG. 4 is a perspective view of an embodiment of a carton assembly of the present invention.

FIGS. 4–9 present several views of an embodiment of a carton assembly 125 of the present invention in which the dispensing portion 130 has not been removed. As shown in the Figures, the carton assembly is a parallelepiped. FIG. 4 is a perspective view of a carton assembly 125 of the present invention in which the dispensing portion 130 has not been removed.

Figure 5:
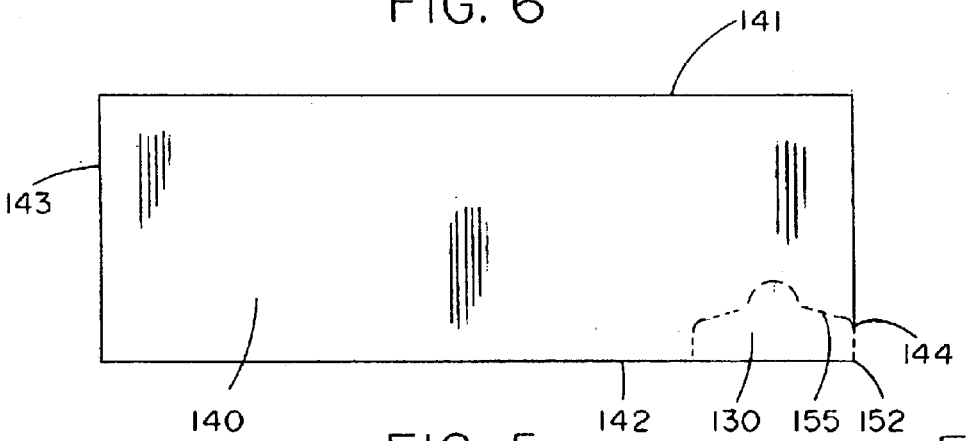
FIG. 5 is a side elevational view of an embodiment of a carton assembly of the present invention.

FIG. 5 is a side elevational view of an embodiment of a carton assembly of the present invention showing the first side wall 140 and the perforation line 155. The first side wall 140 has a top edge 141, a bottom edge 142, a first end edge 143, and a second end edge 144.

Figure 6:
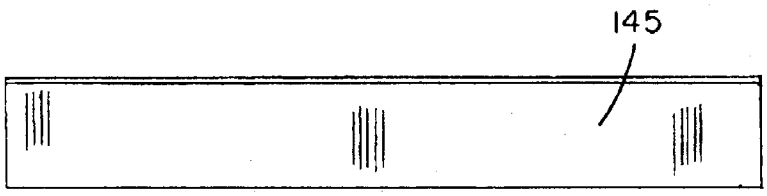
FIG. 6 is a top elevational view of an embodiment of a carton assembly of the present invention.
Figure 7:
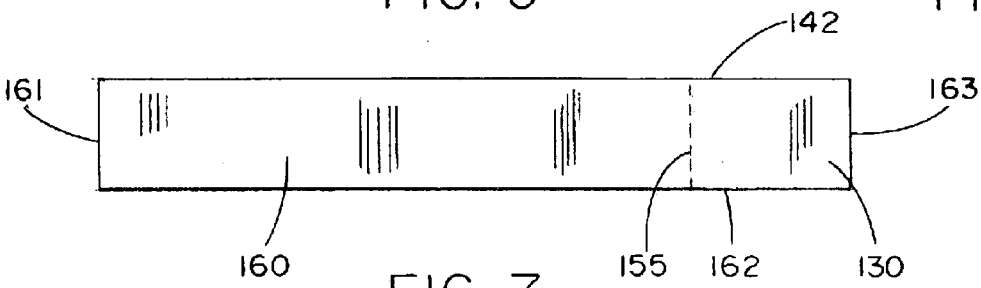
FIG. 7 is a bottom elevational view of an embodiment of a carton assembly of the present invention.

FIG. 6 is a top elevational view of an embodiment of a carton assembly of the present invention showing the top wall 145. FIG. 7 is a bottom elevational view of an embodiment of a carton assembly of the present invention showing the bottom wall 160 and the perforation line 155. The bottom wall 160 has a first end edge 161 and a second end edge 163.

Figure 9:
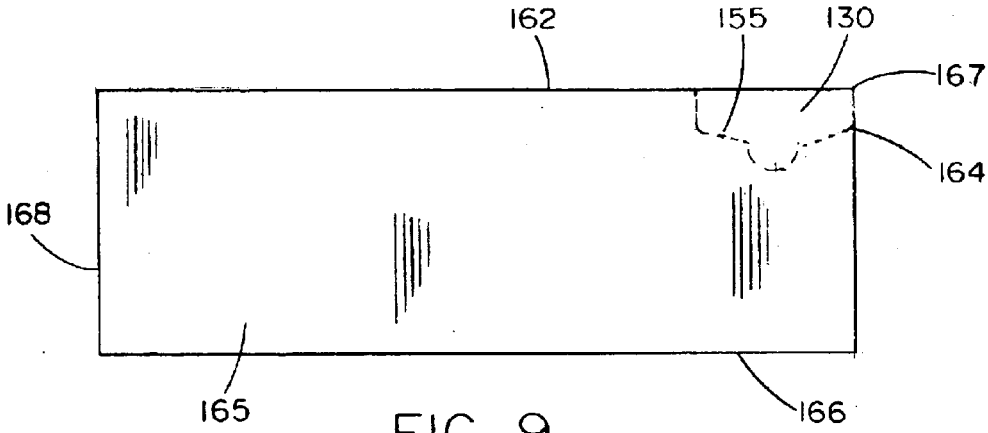
FIG. 9 is another side elevational view of the second side of the embodiment of the carton assembly shown in FIGS. 4–8.
Figure 8:
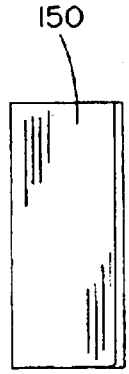
FIG. 8 is another side elevational view of an embodiment of a carton assembly of the present invention.

FIG. 8 is another side elevational view of an embodiment of a carton assembly of the present invention showing the first end wall 150. FIG. 9 is a side elevational view of the second side wall 165 of the embodiment of the carton assembly shown in FIGS. 4–8. The second side wall 165 has a top edge 166, a bottom edge 162, a first end edge 168, and a second end edge 164.

As shown in FIGS. 4–9, the perforation line 155 extends from the first side wall 140, across the bottom edge 142 of the first side wall 140, across the width of the bottom wall 160, across the bottom edge 162 of the second side wall 165, and onto the second side wall 165. The first end of the perforation line 155 terminates at a corner 152 where the bottom edge 142 of the first side wall 140 and the second end edge 144 of the first side wall 140 intersect. From this corner 152, the perforation line 155 extends along a portion of the second end edge 144 of the first side wall 140 before extending across the face of the first side wall 140. The second end of the perforation line 155 terminates at a corner 167 where the bottom edge 162 of the second side wall 165 and the second end edge 164 of the second side wall 165 intersect. From this corner 167, the perforation line 155 extends along a portion of the second end edge 164 of the second side wall 165 before extending across the face of the side wall 165. Thus, the perforation line 155 begins at the first corner 152, extends from the first corner 152 along a portion of the second end edge 144 of the first side wall 140, onto the first side wall 140, across the bottom edge 142 of the first side wall 140, across the bottom wall 160, across the bottom edge 162 of the second side wall 165, onto the second wall 165, and along a portion of the second end edge 164 of the second side wall 165, and wherein the perforation line terminates at the second corner 167.

FIGS. 10–14 present several views of an embodiment of a carton assembly 175 of the present invention in which the dispensing portion 195 has been removed. In these figures, the perforation line on the unopened carton assembly has been torn to remove the dispensing portion.

Figure 10:
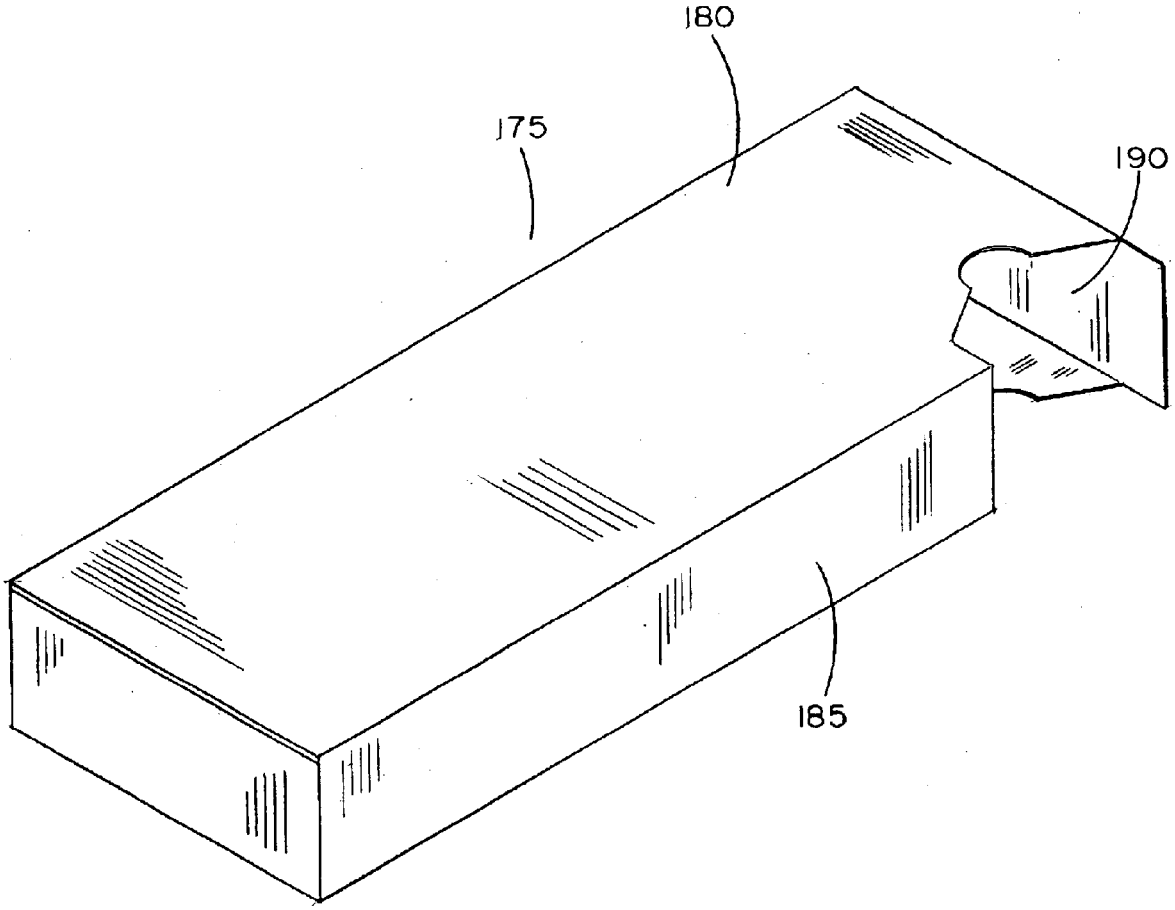
FIG. 10 is a perspective view of an embodiment of a carton assembly according to the present invention.
Figure 11:
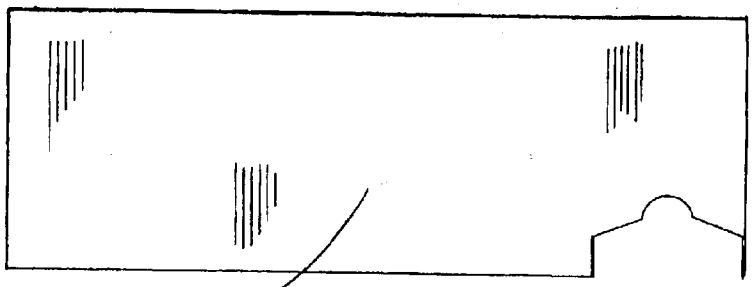
FIG. 11 is a side elevational view of an embodiment of a carton assembly according to the present invention.
Figure 13:
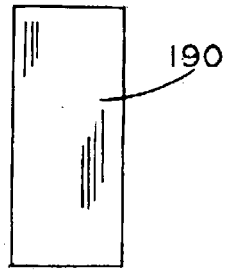
FIG. 13 is another side elevational view of an embodiment of a carton assembly according to the present invention.
Figure 12:
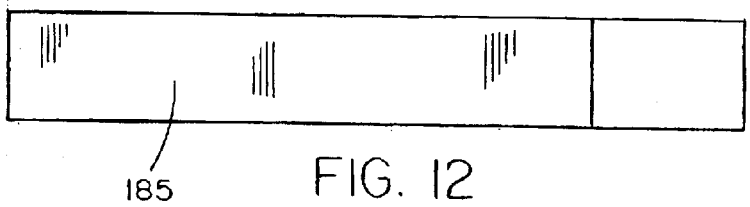
FIG. 12 is a bottom elevational view of an embodiment of a carton assembly according to the present invention.

FIG. 10 is a perspective view of a carton assembly 175 of the present invention in which the dispensing portion has been removed. FIG. 11 is a side elevational view of an embodiment of a carton assembly of the present invention with the dispensing portion removed showing the first side wall 180. FIG. 12 is a bottom elevational view of an embodiment of a carton assembly of the present invention with the dispensing portion removed showing the bottom wall 185. FIG. 13 is another side elevational view of an embodiment of a carton assembly of the present invention with the dispensing portion removed showing the first end wall 190.

The length of the dispensing portion is preferably equal to the width of a package of cigarettes. The width of the dispensing portion is preferably equal to the depth of the carton (i.e., the depth of two packages of cigarettes). When a dispensing portion having these dimensions is used and removed from a carton assembly of the present invention, one or two cigarette packages may be removed from the carton assembly as illustrated in FIG. 14.

Figure 14:
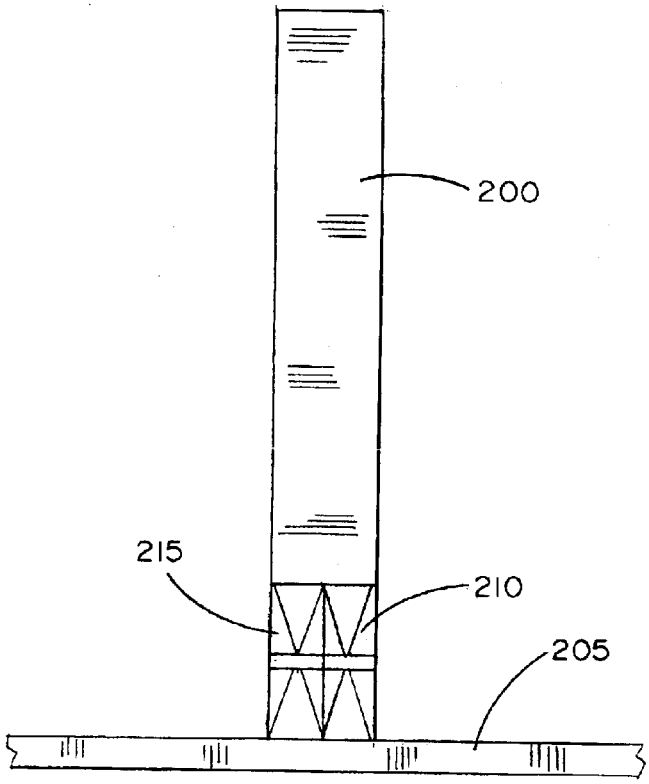
FIG. 14 is a side elevational view of a carton assembly of the present invention positioned on a flat surface.

FIG. 14 is a side elevational view of a carton assembly 200 containing cigarette packages 210,215 of the present invention with the dispensing portion removed. The carton assembly 200 is vertically oriented on a flat surface 205. With the dispensing portion removed, a consumer may easily remove cigarette packages 210,215 from the carton assembly 200.

In another embodiment, the dispensing portion may be hinged. As used herein, the term "hinged" refers to the capability of the dispensing portion to pivot and move from an open configuration to a closed configuration. When the carton is assembled, the hinge of the dispensing portion (e.g., the crease in the paperboard that allows the dispensing portion to open and close) is preferably at or near the intersection of the bottom wall and one of the end walls. The hinge is preferably located on the second end wall less than one inch above the intersection of the bottom wall and a second reinforcing tab. In another embodiment, the dispensing portion is hinged at the intersection of the bottom wall and the second end wall of the carton assembly (the intersection of the bottom wall and the second reinforcing tab of the unassembled carton). In other embodiments, the dispensing portion may be hinged at other locations on the bottom wall.

Figure 15:
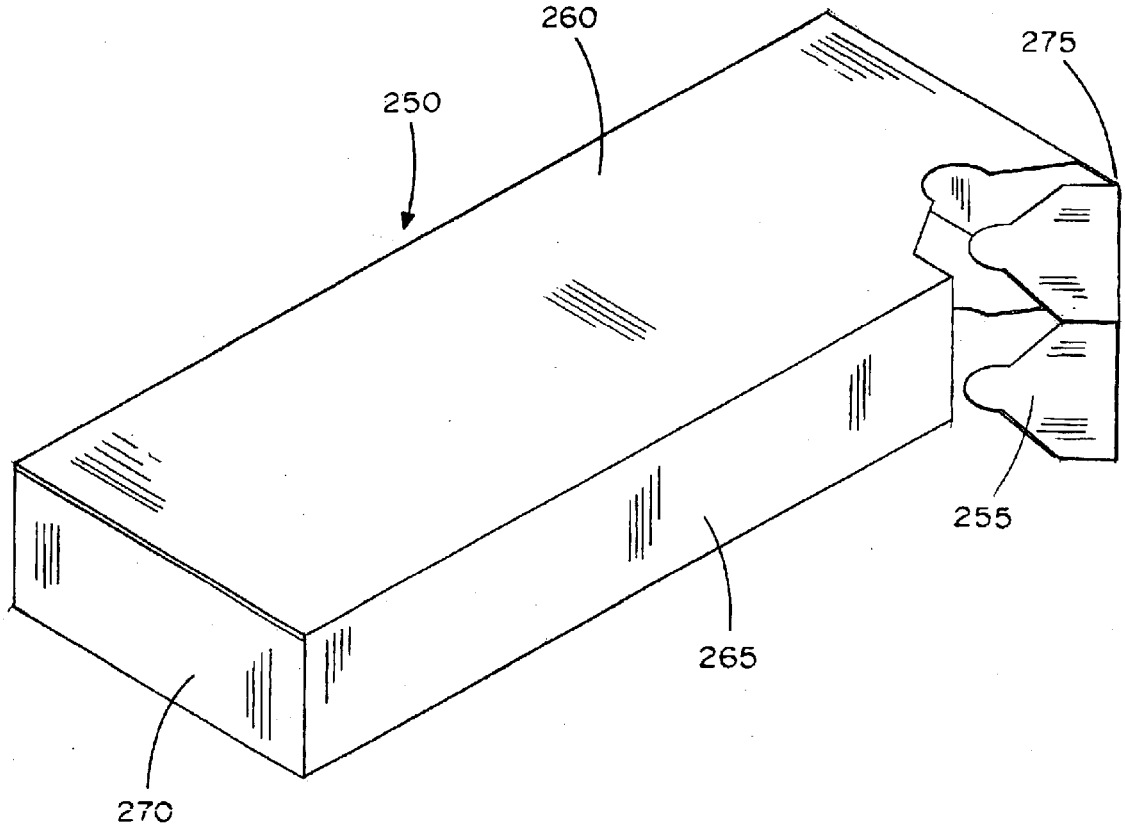
FIG. 15 is a perspective view of another embodiment of a carton assembly of the present invention having a hinged dispensing portion.

FIG. 15 is a perspective view of an embodiment of a carton assembly 250 of the present invention having a hinged dispensing portion 255. In this embodiment, the perforation line in the unopened carton assembly extends to the corner 275 where the side walls, bottom wall and end wall or end flap intersect. Thus, the dispensing portion 255 is not removable, but pivots between an open configuration and a closed configuration to allow for the removal of cigarette packages.

Figure 16:
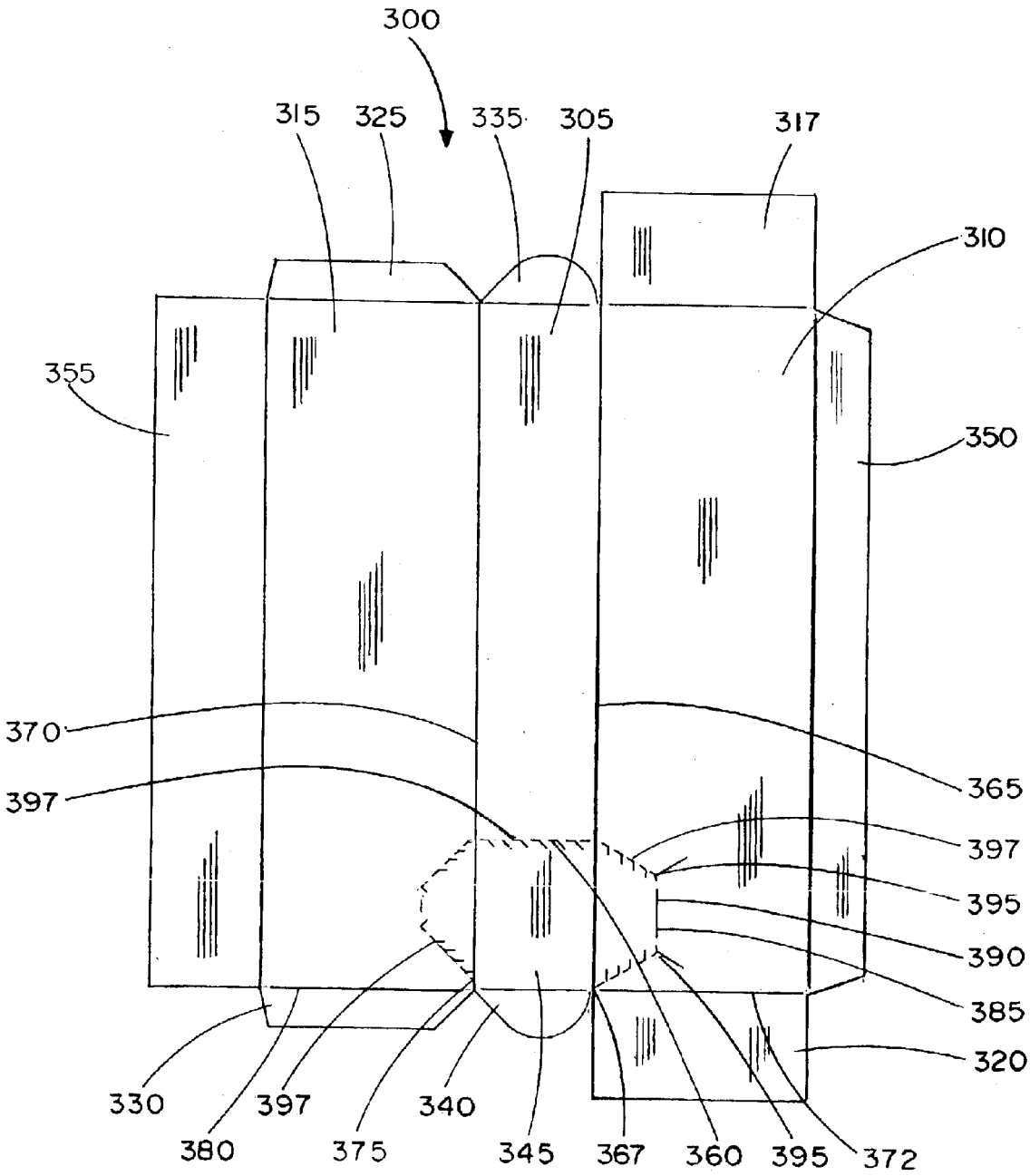
FIG. 16 is a top plan view of an embodiment of a blank portion for making a carton assembly according to the present invention.

FIG. 16 is a top plan view of another embodiment of a blank portion 300 for making an embodiment of a carton assembly according to the present invention. The blank portion 300 is designed to form an assembled "standard" carton for ten cigarette packages arranged in a two by five configuration. As noted above, other blank portions for making carton assemblies according to the present invention may be designed to hold any number of cigarette packages.

The blank portion shown may be prepared from paperboard using techniques known to those of ordinary skill in the art. In addition, the blank portion may be assembled into a carton assembly using techniques known to those of ordinary skill in the art.

The blank portion 300 preferably is prepared from paperboard sheet, and includes a plurality of fold lines, creases or score lines (shown as solid lines in FIG. 16), and cuts or slits (shown as shorter lines in FIG. 16). The size of the cuts can vary, and can be provided as desired. The size and arrangement of the cuts are arranged such that a dispensing portion 345 can be removed. The cuts can be conveniently made by slitting the blank without necessarily removing material therefrom. The folds, creases, and score lines of the blank portion define panels which correspond to walls, portions, sides and flaps of the carton assembly, which ultimately is constructed from the blank portion 300.

The blank portion 300 includes a bottom wall 305 corresponding to the bottom of the carton assembly, a first side wall 310, a second side wall 315, a first end wall 317 positioned integral with and at one end of the first side wall 310, and a second end wall 320 positioned integral with and at the other end of the first side wall 310. The length of the first side wall 310, in the embodiment shown, is equal to the width of five cigarette packages. As noted above, FIGS. 2 and 3 are elevational views of a typical cigarette package 115 illustrating what is meant by the height (H), width (W) and depth (D) of a cigarette package. The length of the second side wall 315 also is equal to the width of five cigarette packages. The width of each side wall 310,315 is equal to the height of a cigarette package. The width of the bottom wall 305 is equal to the depth of two cigarette packages. The dimensions of the carton assembly may vary depending on the size of the cigarette packages and the number of cigarette packages to be contained therein. For example, a cigarette package containing 100 mm cigarettes would require a side wall with a greater width (i.e., a taller cigarette carton assembly) than a cigarette package containing 85 mm cigarettes.

The blank portion 300 also includes a first end flap 325 integral with and at one end of second side wall 315, a second end flap 330 integral with and at the other end of second side wall 315, and reinforcing tabs 335,340 integral with and at the ends of the bottom wall 305. While the first reinforcing tab 335 may be optional, a preferred embodiment of the present invention includes both reinforcing tabs 335,340. The second reinforcing tab 340 is positioned near the dispensing portion 345. The blank portion 300 also includes a top flap 350 integral with and to one side of the first side wall 310 and a top wall 355 integral with and to one side of the second side wall 315.

When assembled, the top wall 355 overlaps the top flap 350 to form the top of the carton. The first end wall 317 overlaps the first end flap 325 and the first reinforcing tab 335 while the second end wall 320 overlaps the second end flap 330 and the second reinforcing tab 340.

FIG. 16 also shows a dispensing portion 345. The dispensing portion 345 is preferably removable. Before the dispensing portion 345 is removed, it comprises a perforation line 360 on the first and second side walls 310,315 and the bottom wall 305. The perforation line 360 extends from the first side wall 310, across a first edge 365 at the intersection of the bottom wall 305 and the first side wall 310, across the width of the bottom wall 305, across a second edge 370 at the intersection of the bottom wall 305 and the second side wall 315, and onto the second side wall 315. The perforation line 360 will be discussed in greater detail below, but, in the embodiment shown, the perforation line 360 comprises a plurality of angled cuts to provide a zipper-type perforation line.

In the embodiment shown in FIG. 16, the first end 367 of the perforation line 360 terminates at an edge 372 of the first side wall 310 (i.e., the intersection of the first side wall 310 and the second end wall 320). As shown in FIG. 16, the first end 367 of the perforation line 360 preferably terminates at the corner where the first side wall 310, the second end wall 320, and the bottom wall 305 intersect. The second end 375 of the perforation line 360 terminates at an edge 380 of the second side wall 315 (i.e., the intersection of the second side wall 315 and the second end flap 330). As shown in FIG. 16, the second end 375 of the perforation line 360 preferably terminates at the corner where the second side wall 315, the second end flap 330, and the bottom wall 305 intersect.

In the embodiment shown in FIG. 16, the perforation line 360 comprises a plurality of angled cuts and a tear start region 385 on the first side wall 310. In the embodiment shown in FIG. 16, the tear start region comprises an extended cut 390 and two generally "Y-shaped" cuts 395. The generally "Y-shaped" cuts 395 comprise a bent line cut and a straight line cut intersecting the bent line cut. The tear start region 385 assists in the removal of the dispensing portion 345.

To remove the dispensing portion 345, a person may insert a finger or thumb behind the part of the dispensing portion on the first side wall 310 by pushing their finger or thumb into the first side wall 310 just above the extended cut 390 between the straight line cuts of the generally "Y-shaped" cuts 395. The extended cut 390 and the straight line cuts of the generally "Y-shaped" cuts 395 allow this portion of the first side wall 310 to be pushed inward and allow the person to position their finger or thumb behind the dispensing portion 345. The person may grasp this part of the dispensing portion using their finger and thumb. The person may then pull the dispensing portion slightly away from the first side wall 310 and along the perforation line 360 to remove the dispensing portion 340. As noted above, the perforation line 360 further comprises a plurality of angled cuts 397 to provide a zipper-type perforation line, which facilitates removal of the dispensing portion 345 in the above manner.

To further assist in the removal of the dispensing portion 345, in one embodiment, the second reinforcing tab 340 is not adhesively secured (e.g., not glued) to the second end wall 320 or the second end flap 330 when the blank portion is formed into a carton assembly. While the second end wall 320 is preferably adhesively secured to the second end flap 330 as known to those of ordinary skill, the dispensing portion is more easily removed and the structure of the carton assembly is better maintained by not adhesively securing the second reinforcing tab 340.

When the blank portion is assembled into a carton assembly as shown in FIGS. 17–27, the carton preferably holds ten cigarette packages, arranged or positioned in a standard two by five configuration. That is, five packages are positioned side-by-side in a row on the first side portion, and five packages are positioned side-by-side on the second side portion of the carton. The length of the assembled carton is, thus, preferably equal to the width of five packages of cigarettes. The height of the assembled carton is preferably equal to the height of a cigarette package and the depth of the assembled carton is preferably equal to the depth of two cigarette packages. As noted above, while FIGS. 17–27 illustrate a standard cigarette carton assembly designed to contain ten cigarette packages, other embodiments of carton assemblies of the present invention may contain, for example, five cigarette packages (in a one by five configuration) or eight cigarette packages (in a two by four configuration).

Figure 17:
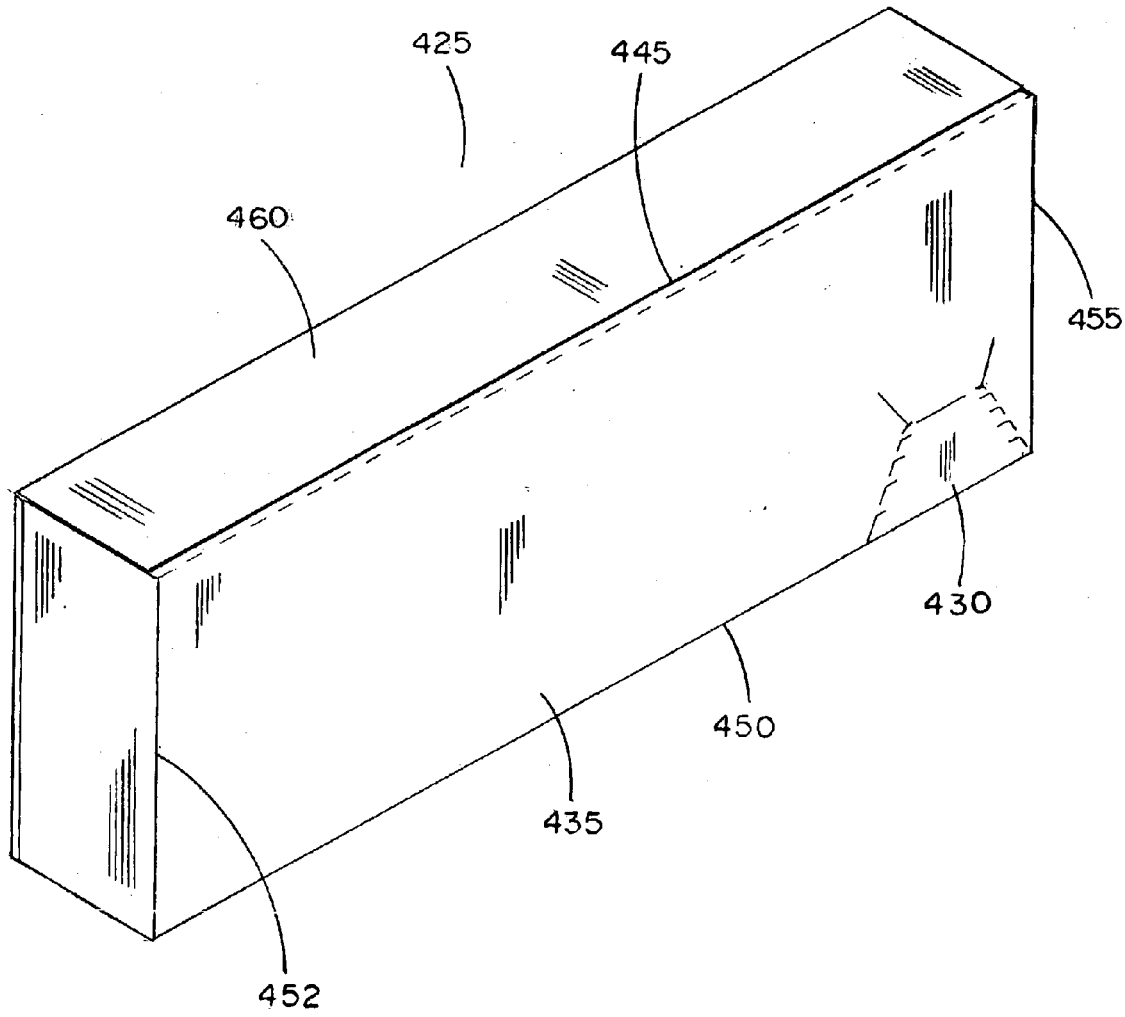
FIG. 17 is a perspective view of an embodiment of a carton assembly of the present invention.

FIGS. 17–22 present several views of another embodiment of a carton assembly 425 of the present invention in which the dispensing portion 430 has not been removed. The carton assembly 420 can be formed from a blank portion like the one shown in FIG. 16. As shown in the Figures, the carton assembly 425 is a parallelepiped. FIG. 17 is a perspective view of a carton assembly 425 of the present invention in which the dispensing portion 430 has not been removed.

Figure 18:
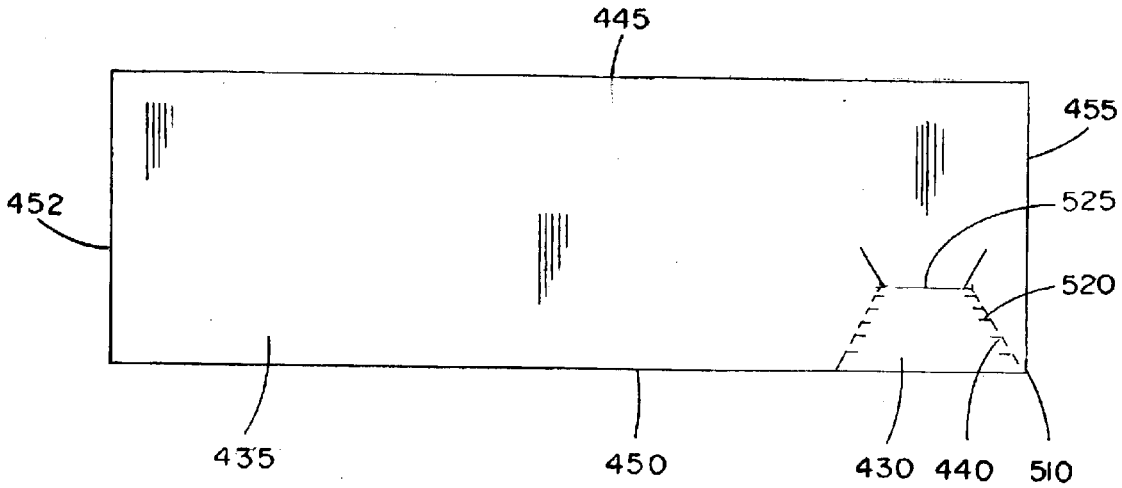
FIG. 18 is a side elevational view of an embodiment of a carton assembly of the present invention.

FIG. 18 is a side elevational view of an embodiment of a carton assembly of the present invention showing the first side wall 435 and a perforation line 440. The first side wall 435 has a top edge 445, a bottom edge 450, a first end edge 452, and a second end edge 455.

Figure 19:
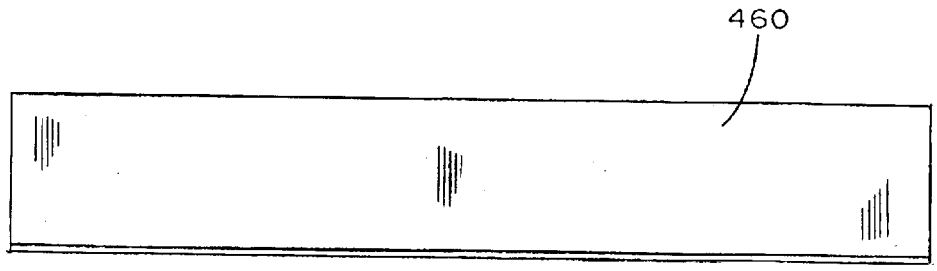
FIG. 19 is a top elevational view of an embodiment of a carton assembly of the present invention.
Figure 20:
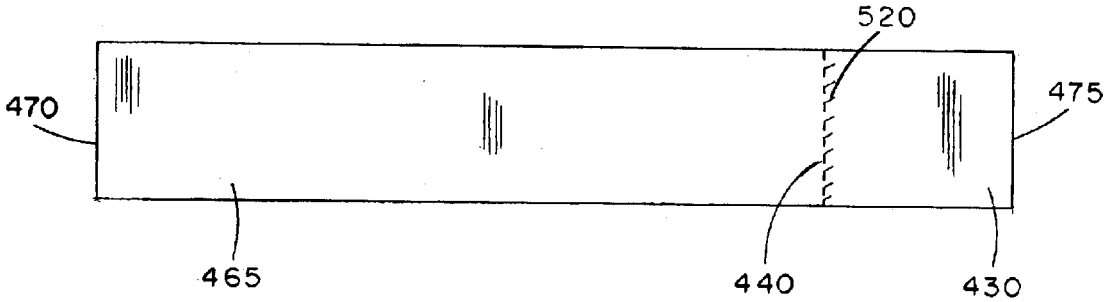
FIG. 20 is a bottom elevational view of an embodiment of a carton assembly of the present invention.

FIG. 19 is a top elevational view of an embodiment of a carton assembly of the present invention showing the top wall 460. FIG. 20 is a bottom elevational view of an embodiment of a carton assembly of the present invention showing the bottom wall 465 and the perforation line 440. The bottom wall 465 has a first end edge 470 and a second end edge 475.

Figure 22:
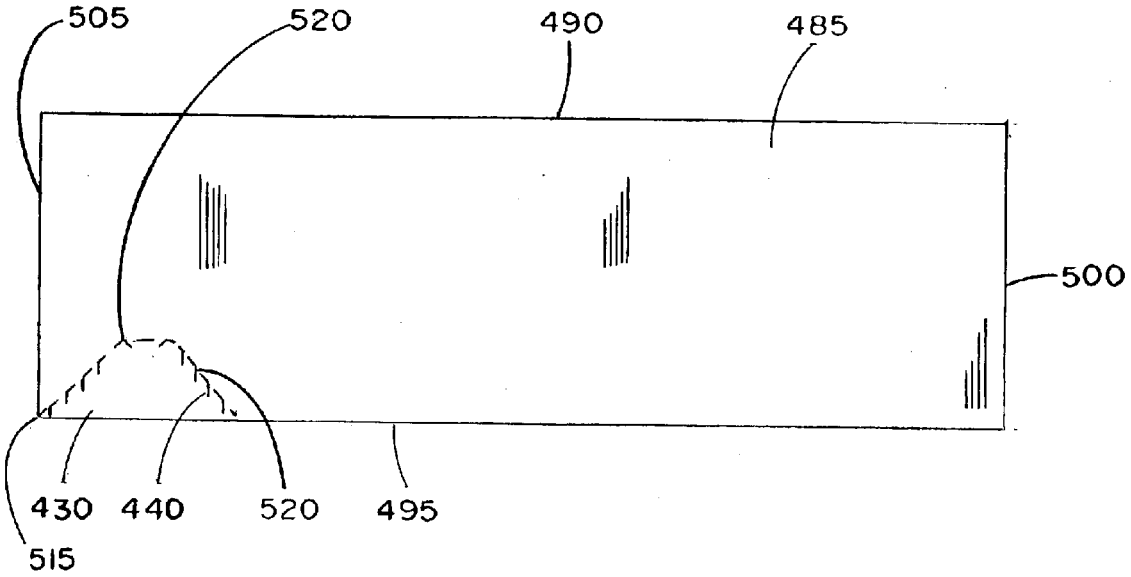
FIG. 22 is another side elevational view of the second side of the embodiment of the carton assembly shown in FIGS. 18–21.
Figure 21:
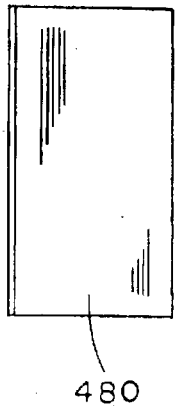
FIG. 21 is another side elevational view of an embodiment of a carton assembly of the present invention.

FIG. 21 is another side elevational view of an embodiment of a carton assembly of the present invention showing the first end wall 480. FIG. 22 is a side elevational view of the second side wall 485 of the embodiment of the carton assembly shown in FIGS. 17–21. The second side wall 485 has a top edge 490, a bottom edge 495, a first end edge 500, and a second end edge 505.

As shown in FIGS. 17–22, the perforation line 440 extends from the first side wall 435, across the bottom edge 450 of the first side wall 435, across the width of the bottom wall 465, across the bottom edge 495 of the second side wall 485, and onto the second side wall 485. The first end of the perforation line 440 terminates at a corner 510 where the bottom edge 450 of the first side wall 435 and the second end edge 455 of the first side wall 435 intersect. From this corner 510, the perforation line 440 extends onto the face of the first side wall 435. The second end of the perforation line 440 terminates at a second corner 515 where the bottom edge 495 of the second side wall 485 and the second end edge 505 of the second side wall 485 intersect. From this corner 515, the perforation line 440 extends onto the face of the second side wall 485. Thus, in the embodiment shown, the perforation line 440 begins at the first corner 510, extends onto the first side wall 435, across the bottom edge 450 of the first side wall 435, across the bottom wall 465, across the bottom edge 495 of the second side wall 485, onto the second side wall 485, and terminates at the second corner 515.

As discussed in connection with the embodiment of the blank portion illustrated in FIG. 16, the perforation line 440 comprises a plurality of angled cuts 520 and a tear start region 525 on the first side wall 435.

FIGS. 23–27 present several views of an embodiment of a carton assembly 550 of the present invention in which the dispensing portion has been removed. In these figures, the perforation line on the unopened carton assembly has been torn to remove the dispensing portion.

Figure 23:
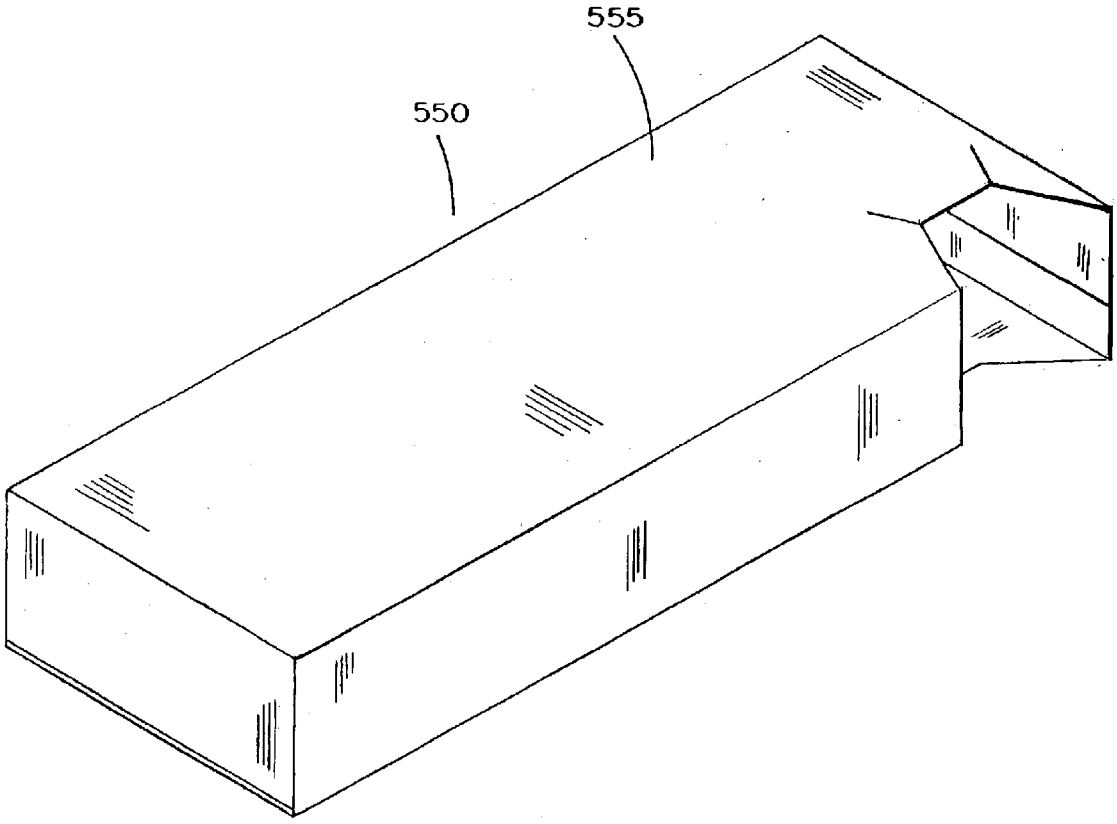
FIG. 23 is a perspective view of an embodiment of a carton assembly according to the present invention.
Figure 24:
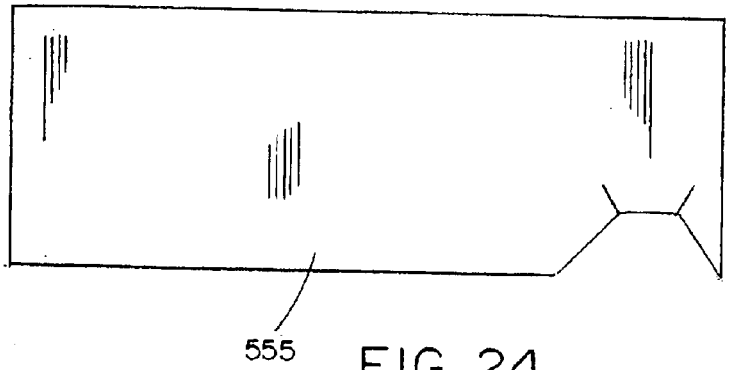
FIG. 24 is a side elevational view of an embodiment of a carton assembly according to the present invention.
Figure 26:
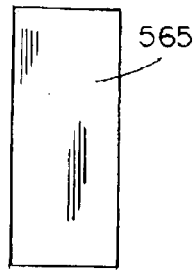
FIG. 26 is another side elevational view of an embodiment of a carton assembly according to the present invention.
Figure 25:
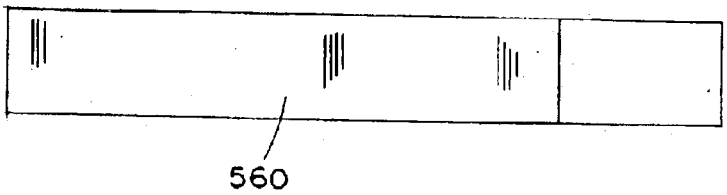
FIG. 25 is a bottom elevational view of an embodiment of a carton assembly according to the present invention.

FIG. 23 is a perspective view of an embodiment of a carton assembly 550 of the present invention in which the dispensing portion has been removed. FIG. 24 is a side elevational view of an embodiment of a carton assembly of the present invention with the dispensing portion removed showing the first side wall 555. FIG. 25 is a bottom elevational view of an embodiment of a carton assembly of the present invention with the dispensing portion removed showing the bottom wall 560. FIG. 26 is another side elevational view of an embodiment of a carton assembly of the present invention with the dispensing portion removed showing the first end wall 565.

The length of the dispensing portion is preferably equal to the width of a package of cigarettes. The width of the dispensing portion is preferably equal to the depth of the carton (i.e., the depth of two packages of cigarettes). When a dispensing portion having these dimensions is used and removed from a carton assembly of the present invention, one or two cigarette packages may be removed from the carton assembly as illustrated in FIG. 27.

Figure 27:
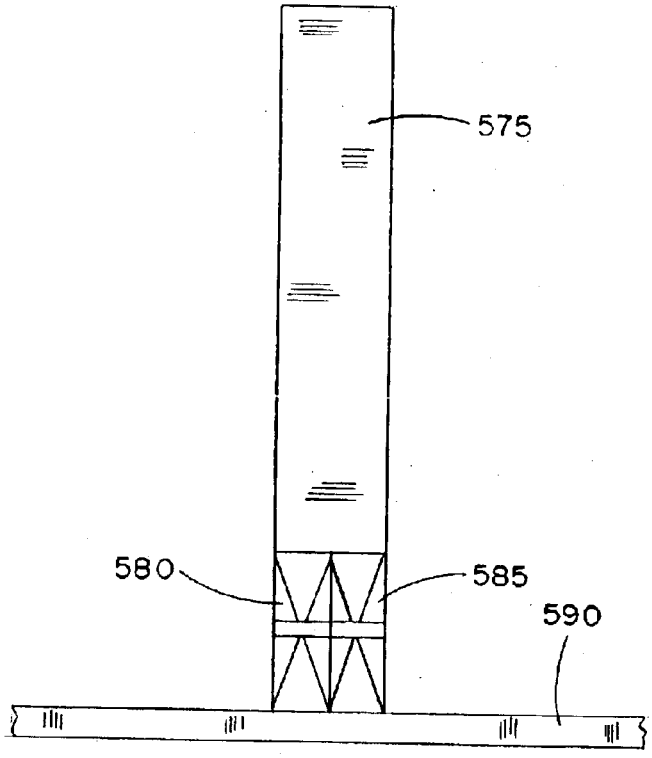
FIG. 27 is a side elevational view of a carton assembly of the present invention positioned on a flat surface.

FIG. 27 is a side elevational view of a carton assembly 575 containing cigarette packages 580,585 of the present invention with the dispensing portion removed. The carton assembly 575 is vertically oriented on a flat surface 590. With the dispensing portion removed, a consumer may easily remove cigarette packages 580,585 from the carton assembly 575.

As with the embodiment of the carton assembly shown in FIG. 15, in other embodiments of the carton assembly shown in FIGS. 17–27, the dispensing portion may be hinged.

Figure 28:
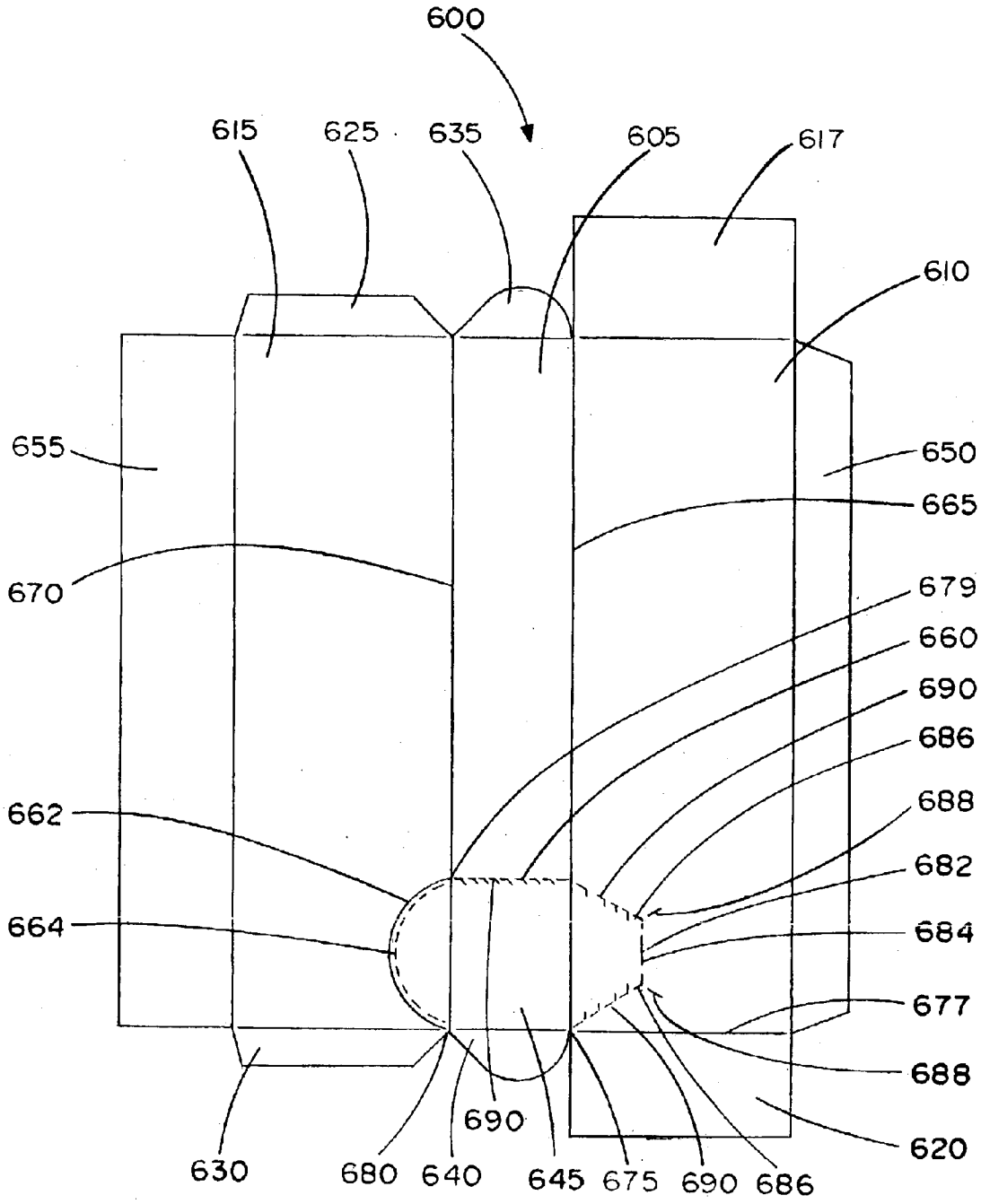
FIG. 28 is a top plan view of an embodiment of a blank portion for making a carton assembly according to the present invention.

FIG. 28 is a top plan view of another embodiment of a blank portion 600 for making an embodiment of a carton assembly according to the present invention. The blank portion 600 is designed to form an assembled "standard" carton for ten cigarette packages arranged in a two by five configuration. As noted above, other blank portions for making carton assemblies according to the present invention may be designed to hold any number of cigarette packages.

The blank portion shown may be prepared from paperboard using techniques known to those of ordinary skill in the art. In addition, the blank portion may be assembled into a carton assembly using techniques known to those of ordinary skill in the art.

The blank portion 600 preferably is prepared from paperboard sheet, and includes a plurality of fold lines, creases or score lines (shown as solid lines in FIG. 28), and cuts or slits (shown as shorter lines in FIG. 28). The size of the cuts can vary, and can be provided as desired. The size and arrangement of the cuts are arranged such that a dispensing portion 645 can be removed. The cuts can be conveniently made by slitting the blank without necessarily removing material therefrom. The folds, creases, and score lines of the blank portion define panels which correspond to walls, portions, sides and flaps of the carton assembly, which ultimately is constructed from the blank portion 600.

The blank portion 600 includes a bottom wall 605 corresponding to the bottom of the carton assembly, a first side wall 610, a second side wall 615, a first end wall 617 positioned integral with and at one end of the first side wall 610, and a second end wall 620 positioned integral with and at the other end of the first side wall 610. The length of the first side wall 610, in the embodiment shown, is equal to the width of five cigarette packages. As noted above, FIGS. 2 and 3 are elevational views of a typical cigarette package 115 illustrating what is meant by the height (H), width (W) and depth (D) of a cigarette package. The length of the second side wall 615 also is equal to the width of five cigarette packages. The width of each side wall 610,615 is equal to the height of a cigarette package. The width of the bottom wall 605 is equal to the depth of two cigarette packages. The dimensions of the carton assembly may vary depending on the size of the cigarette packages and the number of cigarette packages to be contained therein. For example, a cigarette package containing 100 mm cigarettes would require a side wall with a greater width (i.e., a taller cigarette carton assembly) than a cigarette package containing 85 mm cigarettes.

The blank portion 600 also includes a first end flap 625 integral with and at one end of second side wall 615, a second end flap 630 integral with and at the other end of second side wall 615, and reinforcing tabs 635,640 integral with and at the ends of the bottom wall 605. While the first reinforcing tab 635 may be optional, a preferred embodiment of the present invention includes both reinforcing tabs 635,640. The second reinforcing tab 640 is positioned near the dispensing portion 645. The blank portion 600 also includes a top flap 650 integral with and to one side of the first side wall 610 and a top wall 655 integral with and to one side of the second side wall 615.

When assembled, the top wall 655 overlaps the top flap 650 to form the top of the carton. The first end wall 617 overlaps the first end flap 625 and the first reinforcing tab 635 while the second end wall 620 overlaps the second end flap 630 and the second reinforcing tab 640.

FIG. 28 also shows a dispensing portion 645. The dispensing portion 645 is preferably removable. Before the dispensing portion 645 is removed, it comprises a first perforation line 660 on the first side wall 610 and the bottom wall 605 and a score line 662 on the second side wall 615. A second perforation line 664 is also shown on the second side wall 615 and is in general alignment with the score line 662. The first perforation line 660 extends from the first side wall 610, across a first edge 665 at the intersection of the bottom wall 605 and the first side wall 610, and across the width of the bottom wall 605 to the second edge 670 at the intersection of the bottom wall 605 and the second side wall 615. The score line 662, in the embodiment shown, extends generally from the location on the second edge 670 where the first perforation line 660 terminates onto the second side wall 615.

In the embodiment shown, the first perforation line 660 comprises a plurality of angled cuts to provide a zipper-type perforation line. The second perforation line 664, in one embodiment, comprises one thirty-second of an inch (1/32") perforations with one thirty-second of an inch (1/32") perforation gaps. The score line 662, in one embodiment, is a partial score line, such that the score line 662 is not cut entirely through the paperboard sheet. In one embodiment, the score line is cut approximately 50% through the thickness of the paperboard sheet.

In the embodiment shown in FIG. 28, the first end 675 of the first perforation line 660 terminates at an edge 677 of the first side wall 610 (i.e., the intersection of the first side wall 610 and the second end wall 620). As shown in FIG. 28, the first end 675 of the first perforation line 660 preferably terminates at the corner where the first side wall 610, the second end wall 620, and the bottom wall 605 intersect. The second end 679 of the first perforation line 660 terminates at the edge 670 where the bottom wall 605 and the second side wall 615 intersect.

The score line 662 extends generally from the location on the edge 670 where the second end 679 of the first perforation line 660 terminates. The score line 662, in the embodiment shown, is generally arcuate. In other embodiments, the score line may have different shapes. As shown in FIG. 28, the score line 662 is semi-circular and terminates at the corner 680 where the second side wall 615, the second end flap 630, and the bottom wall 605 intersect. The second perforation line 664, in the embodiment shown, is also semicircular and is in general alignment with the score line 662. Due to its close proximity to the score line 662, the second perforation line also extends generally from the location on the edge 670 where the second end 679 of the first perforation line 660 terminates, and terminates at the corner 680 where the second side wall 615, the second end flap 630, and the bottom wall 605 intersect.

In the embodiment shown in FIG. 28, the first perforation line 660 comprises a plurality of angled cuts and a tear start region 682 on the first side wall 610. In the embodiment shown in FIG. 28, the tear start region comprises an extended cut 684, two bent line cuts 686, and two straight cuts 688 intersecting the bent line cuts 686. The tear start region 682 assists in the removal of the dispensing portion 645.

To remove the dispensing portion 645, a person may insert a finger or thumb behind the part of the dispensing portion on the first side wall 610 by pushing their finger or thumb into the first side wall 610 just above the extended cut 684 between the straight cuts 688. The extended cut 684 and the straight cuts 688 allow this portion of the first side wall 610 to be pushed inward and allow the person to position their finger or thumb behind the dispensing portion 645. The person may grasp this part of the dispensing portion using their finger and thumb. The person may then pull the dispensing portion slightly away from the first side wall 610 along the first perforation line 660 to the edge 670 where the second side wall 615 and bottom wall 605 intersect, and then along the score line 662 and second perforation line 664 to remove the dispensing portion 640.

The first perforation line 660 also comprises a plurality of angled cuts 690 to provide a zipper-type perforation line, which facilitates removal of the dispensing portion 645 in the above manner.

To further assist in the removal of the dispensing portion 645, in one embodiment, the second reinforcing tab 640 is not adhesively secured (e.g., not glued) to the second end wall 620 or the second end flap 630 when the blank portion is formed into a carton assembly. While the second end wall 620 is preferably adhesively secured to the second end flap 630 as known to those of ordinary skill, the dispensing portion is more easily removed and the structure of the carton assembly is better maintained by not adhesively securing the second reinforcing tab 640.

The blank portion 600 may be assembled into a carton assembly in a manner similar to that described with regard to FIGS. 17–27 above.

The following examples are provided in order to further illustrate aspects of the invention but should not be construed as limiting the scope thereof.

EXAMPLE 1

An example of an embodiment of this invention is as follows. A carton assembly has a length of about 282 mm, a height of about 88 mm, and a width of about 48 mm, and contains 10 packages of 20 cigarettes. The packages are arranged in 2 rows in a 1 by 5 fashion within the carton assembly. The carton assembly is manufactured from paperboard having a thickness of about 0.25 mm to about 0.30 mm, preferably of about 0.267 mm to about 0.292 mm. The carton assembly is provided from an unassembled blank portion of the type shown in FIG. 16.

Figure 29:
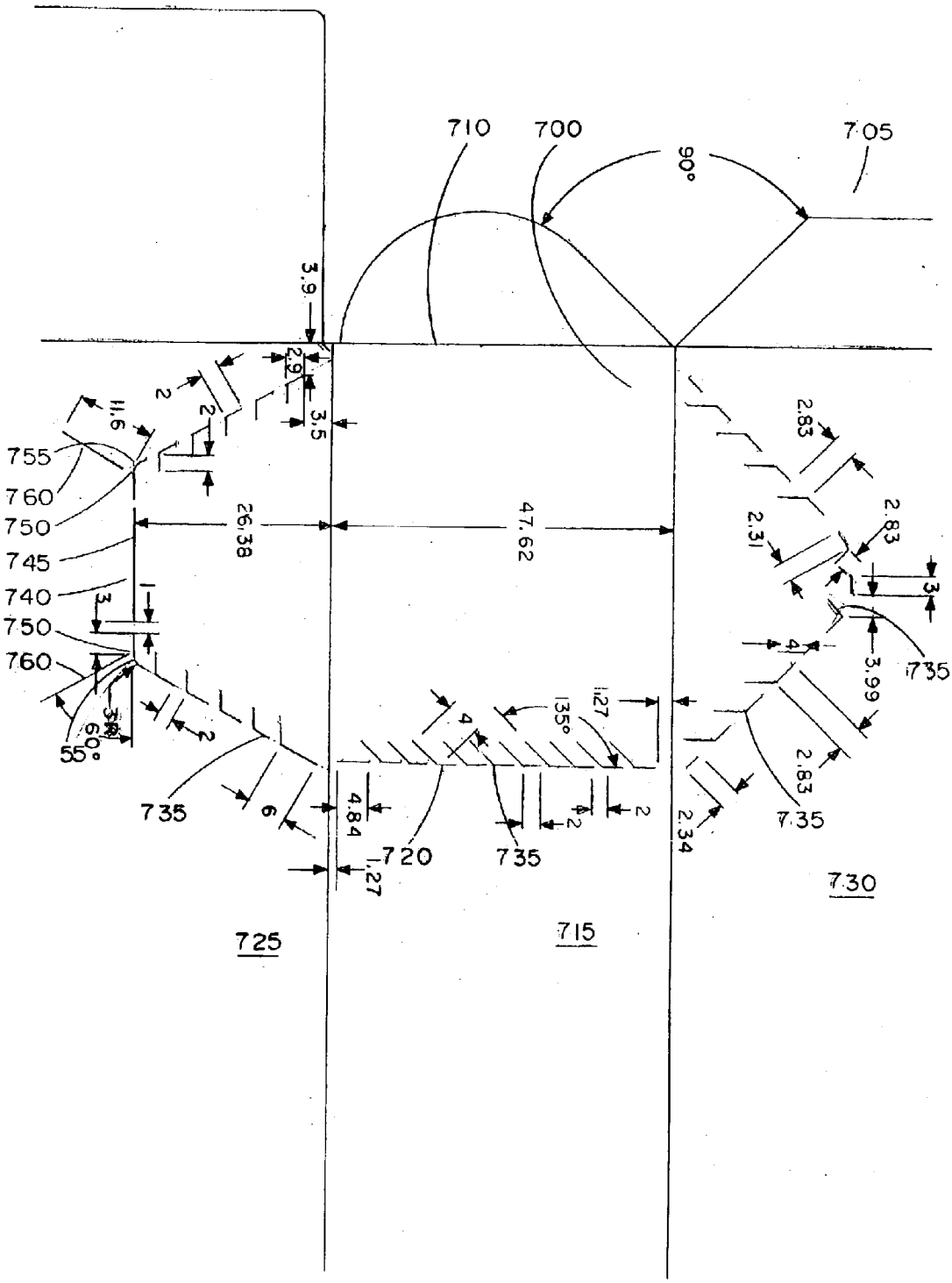
FIG. 29 is a partial plan view of an example of a perforation line on a blank portion for making a carton assembly according to the present invention.

The carton assembly includes a removable dispensing portion. FIG. 29 is a partial plan view of an example of a removable dispensing portion 700 on a blank portion 705 for making a carton assembly according to the present invention. The dispensing portion 700 is defined by a reinforcing tab 708 and by a first end edge 710 of the bottom wall 715 and a perforation line 720. The perforation line 720 has two ends and has portions on the first side wall (partially shown) 725, the bottom wall 715, and the second side wall (partially shown) 730.

The perforation line 720 comprises a plurality of angled cuts 735 and a tear start region 740 on the first side wall 725. The tear start region comprises an extended cut 745 and two generally "Y-shaped" cuts 750. The generally "Y-shaped" cuts 750 comprise a bent line cut 755 and a straight line cut 760 intersecting the bent line cut. The dimensions, spacing, and other relevant information relating to the cuts forming the perforation line are shown in FIG. 29. These cuts may be made in the blank portion using techniques known to those of ordinary skill in the art.

EXAMPLE 2

A second example of an embodiment of this invention is as follows. A carton assembly has a length of about 282 mm, a height of about 88 mm, and a width of about 48 mm, and contains 10 packages of 20 cigarettes. The packages are arranged in 2 rows in a 1 by 5 fashion within the carton assembly. The carton assembly is manufactured from paperboard having a thickness of about 0.25 mm to about 0.30 mm, preferably of about 0.267 mm to about 0.292 mm. The carton assembly is provided from an unassembled blank portion of the type shown in FIG. 28.

Figure 30:
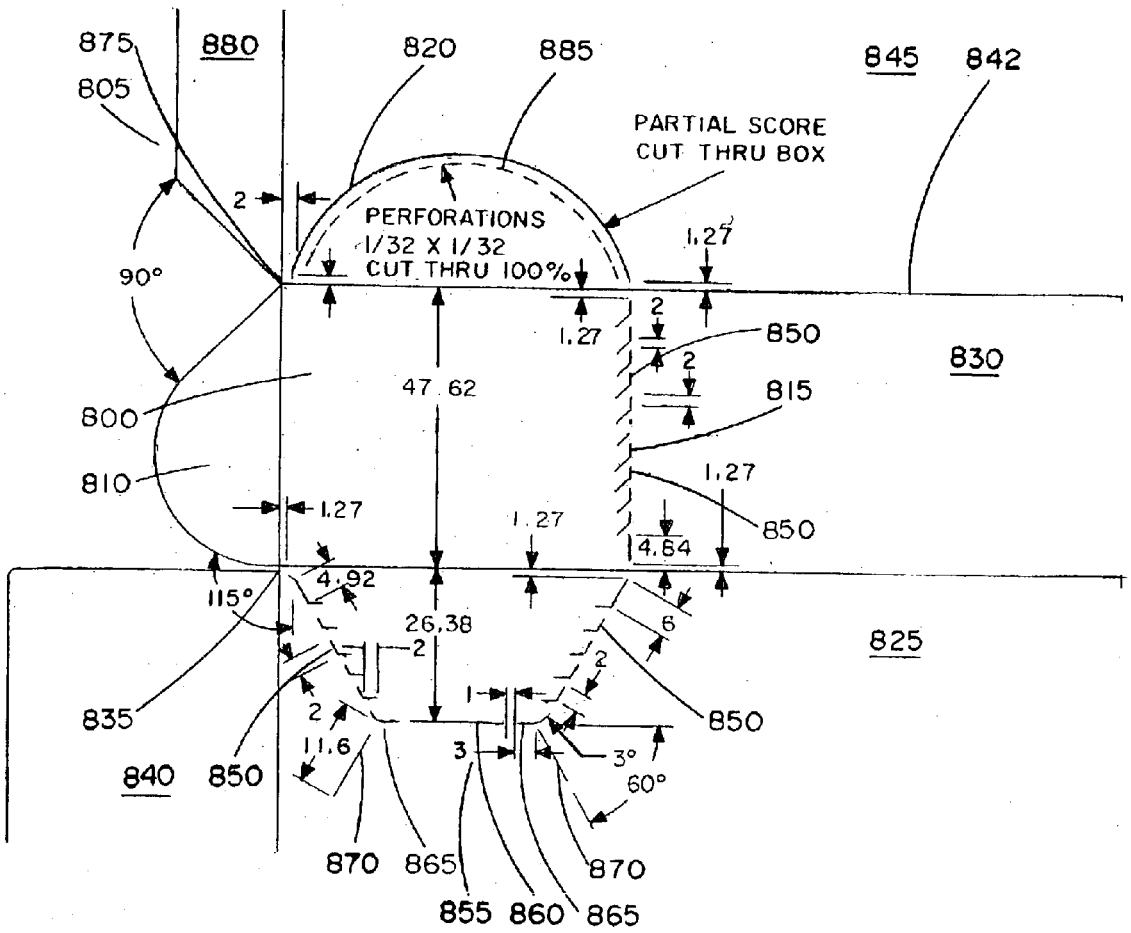
FIG. 30 is a partial plan view of an example of a perforation line on a blank portion for making a carton assembly according to the present invention.

The carton assembly includes a removable dispensing portion. FIG. 30 is a partial plan view of an example of a removable dispensing portion 800 on a blank portion 805 for making a carton assembly according to the present invention. The dispensing portion 800 is defined by a reinforcing tab 810, a first perforation line 815, and a score line 820. The first perforation line 815 has two ends and has portions on the first side wall (partially shown) 825 and the bottom wall (partially shown) 830. The first perforation line 815 extends from a corner 835 where the first side wall 825, the bottom wall 830, and an end wall 840 intersect, and terminates at the edge 842 where the bottom wall 830 and the second side wall (partially shown) 845 intersect.

The perforation line 815 comprises a plurality of angled cuts 850 and a tear start region 855 on the first side wall 825. The tear start region comprises an extended cut 860, two bent line cuts 865, and two straight cuts 870 intersecting the bent line cuts 865.

The score line 820 extends from the edge 842 where the bottom wall 830 and the second side wall 845 intersect. The score line 820 is semi-circular and terminates at the corner 875 where the second side wall 845, the bottom wall 830, and an end flap (partially shown) 880 intersect. The score line 820 is cut approximately 50% through the thickness of the paperboard sheet.

A second perforation line 885 is also semicircular and is in general alignment with the score line 820. Due to its close proximity to the score line 820, the second perforation line also extends from the edge 842 where the bottom wall 830 and the second side wall 845 intersect, and terminates at the corner 875 where the second side wall 845, the bottom wall 830, and an end flap (partially shown) 880 intersect.

The dimensions, spacing, and other relevant information relating to the cuts forming the perforation lines and the score line are shown in FIG. 30. These cuts may be made in the blank portion using techniques known to those of ordinary skill in the art. With respect to the descriptions set forth above, optimum dimensional relationships for the parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein.

The foregoing is considered as illustrative only of the principles of the invention. Since numerous modifications and changes will readily occur to those skilled in the art, the foregoing is not intended to limit the invention to the exact construction and operation shown and described, and all suitable modifications and equivalents falling within the scope of the appended claims are deemed within the present inventive concept.

The features of the present invention, together with the other objects of the invention, and along with the various features of novelty which characterize the invention, are pointed out with particularity in the claims annexed to and forming a part of this disclosure.

We claim:

1. A cigarette carton assembly, comprising:

a parallelepiped comprising:

(1) a first side wall having a top edge, a bottom edge, a first end edge, and a second end edge;

(2) a second side wall opposite the first side wall and having a top edge, a bottom edge, a first end edge, and a second end edge;

(3) a first end wall positioned between the first end edge of the first side wall and the first end edge of the second side wall;

(4) a second end wall opposite the first end wall and positioned between the second end edge of the first side wall and the second end edge of the second side wall;

(5) a top wall positioned between the top edge of the first side wall and the top edge of the second side wall; and (6) a bottom wall having two end edges, opposite the top wall and positioned between the bottom edge of the first side wall and the bottom edge of the second side wall; and a dispensing portion defined by a first end edge of the bottom wall and a perforation line having two ends and having portions on the first side wall, the bottom wall, and the second side wall, wherein the perforation line extends from the second end edge of the first side wall, onto the first side wall, across the bottom edge of the first side wall, across the bottom wall, across the bottom edge of the second side wall, onto the second wall, and terminates at the second end edge of the second side wall.

2. The cigarette carton assembly of claim 1, further comprising at least one package of cigarettes, each package of cigarettes having a height, a width, and a depth.

3. The cigarette carton assembly of claim 2, wherein a length of the dispensing portion is defined by the distance between the first end edge of the bottom wall and the portion of the perforation line extending across the bottom wall and wherein the length of the dispensing portion is equal to the width of a cigarette package.

4. The cigarette carton assembly of claim 1, further comprising ten packages of cigarettes.

5. The cigarette carton assembly of claim 1, further comprising five packages of cigarettes.

6. The cigarette carton assembly of claim 1, wherein the dispensing portion is removable.

7. The cigarette carton assembly of claim 1, wherein the bottom edge of the first side wall and the second end edge of the first side wall intersect to form a corner and wherein a first end of the perforation line terminates at the corner where the bottom edge of the first side wall and the second end edge of the first side wall intersect.

8. The cigarette carton assembly of claim 7, wherein the bottom edge of the second side wall and the second end edge of the second side wall intersect to form a corner and wherein a second end of the perforation line terminates at the corner where the bottom edge of the second side wall and the second end edge of the second side wall intersect.

9. The cigarette carton assembly of claim 1, wherein the perforation line comprises a plurality of angled cuts.

10. The cigarette carton assembly of claim 9, wherein the perforation line further comprises a tear start region on the first side wall.

11. The cigarette carton assembly of claim 1, wherein the perforation line is a zipper-type perforation line.

12. The cigarette carton assembly of claim 1, wherein the portion of the perforation line on the second side wall is semi-circular.

13. A cigarette carton assembly, comprising:

a parallelepiped comprising:

(1) a first side wall having a top edge, a bottom edge, a first end edge, and a second end edge;

(2) a second side wall opposite the first side wall and having a top edge, a bottom edge, a first end edge, and a second end edge;

(3) a first end wall positioned between the first end edge of the first side wall and the first end edge of the second side wall;

(4) a second end wall opposite the first end wall and positioned between the second end edge of the first side wall and the second end edge of the second side wall;

(5) a top wall positioned between the top edge of the first side wall and the top edge of the second side wall; and (6) a bottom wall having two end edges, opposite the top wall and positioned between the bottom edge of the first side wall and the bottom edge of the second side wall; and a removable dispensing portion defined by a first end edge of the bottom wall and a perforation line, the perforation line having two ends and having portions on the first side wall, the bottom wall, and the second side wall, wherein the bottom edge of the first side wall and the second end edge of the first side wall intersect to form a first corner, wherein the bottom edge of the second side wall and the second end edge of the second side wall intersect to form a second corner, wherein the perforation line extends from the first corner onto the first side wall, across the bottom edge of the first side wall, across the bottom wall, across the bottom edge of the second side wall, and onto the second wall, and wherein the perforation line terminates at the second corner.

14. The cigarette carton assembly of claim 13, further comprising at least one package of cigarettes, each package of cigarettes having a height, a width, and a depth.

15. The cigarette carton assembly of claim 14, wherein a length of the dispensing portion is defined by the distance between the first end edge of the bottom wall and the portion of the perforation line extending across the bottom wall and wherein the length of the dispensing portion is equal to the width of a cigarette package.

16. The cigarette carton assembly of claim 13, further comprising ten packages of cigarettes.

17. The cigarette carton assembly of claim 13, further comprising five packages of cigarettes.

18. The cigarette carton assembly of claim 13, wherein the dispensing portion is removable.

19. The cigarette carton assembly of claim 13, wherein the perforation line comprises a plurality of angled cuts.

20. The cigarette carton assembly of claim 19, wherein the perforation line further comprises a tear start region on the first side wall.

21. The cigarette carton assembly of claim 13, wherein the perforation line comprises a zipper-type perforation line.

22. The cigarette carton assembly of claim 13, wherein the portion of the perforation line on the second side wall is semi-circular.

23. A cigarette carton assembly, comprising:

a parallelepiped comprising:

(1) a first side wall having a top edge, a bottom edge, a first end edge, and a second end edge;

(2) a second side wall opposite the first side wall and having a top edge, a bottom edge, a first end edge, and a second end edge;

(3) a first end wall positioned between the first end edge of the first side wall and the first end edge of the second side wall;

(4) a second end wall opposite the first end wall and positioned between the second end edge of the first side wall and the second end edge of the second side wall;

(5) a top wall positioned between the top edge of the first side wall and the top edge of the second side wall; and (6) a bottom wall having two end edges, opposite the top wall and positioned between the bottom edge of the first side wall and the bottom edge of the second side wall; and a removable dispensing portion defined by a first end edge of the bottom wall and a perforation line having two ends, having portions on the first side wall, the bottom wall, and the second side wall, having a first arcuate region on the first side wall, and having a second arcuate region on the second side wall, wherein the bottom edge of the first side wall and the second end edge of the first side wall intersect to form a first corner, wherein the bottom edge of the second side wall and the second end edge of the second side wall intersect to form a second corner, wherein the perforation line begins at the first corner, wherein the perforation line extends from the first corner along a portion of the second end edge of the first side wall, onto the first side wall, across the bottom edge of the first side wall, across the bottom wall, across the bottom edge of the second side wall, onto the second wall, and along a portion of the second end edge of the second side wall, and wherein the perforation line terminates at the second corner.

24. The cigarette carton assembly of claim 23, further comprising at least one package of cigarettes, each package of cigarettes having a height, a width, and a depth.

25. The cigarette carton assembly of claim 24, wherein a length of the dispensing portion is defined by the distance between the first end edge of the bottom wall and the portion of the perforation line extending across the bottom wall and wherein the length of the dispensing portion is equal to the width of a cigarette package.

26. The cigarette carton assembly of claim 23, further comprising ten packages of cigarettes.

27. The cigarette carton assembly of claim 23, further comprising five packages of cigarettes.

28. A cigarette carton assembly, comprising:

a parallelepiped comprising:

(1) a first side wall having a top edge, a bottom edge, a first end edge, and a second end edge;

(2) a second side wall opposite the first side wall and having a top edge, a bottom edge, a first end edge, and a second end edge;

(3) a first end wall positioned between the first end edge of the first side wall and the first end edge of the second side wall;

(4) a second end wall opposite the first end wall and positioned between the second end edge of the first side wall and the second end edge of the second side wall;

(5) a top wall positioned between the top edge of the first side wall and the top edge of the second side wall; and (6) a bottom wall having two end edges, opposite the top wall and positioned between the bottom edge of the first side wall and the bottom edge of the second side wall; and a dispensing portion defined by a first end edge of the bottom wall, a perforation line having two ends and having portions on the first side wall and the bottom wall, and a score line on the second side wall and having two ends, wherein the perforation line extends from the second end edge of the first side wall, onto the first side wall, across the bottom edge of the first side wall, across the bottom wall, and terminates at the bottom edge of the second side wall, and wherein the score line extends from the bottom edge of the second side wall, across the second side wall, and terminates at the second end edge of the second side wall.

29. The cigarette carton assembly of claim 28, further comprising at least one package of cigarettes, each package of cigarettes having a height, a width, and a depth.

30. The cigarette carton assembly of claim 29, wherein a length of the dispensing portion is defined by the distance between the first end edge of the bottom wall and the portion of the perforation line extending across the bottom wall and wherein the length of the dispensing portion is equal to the width of a cigarette package.

31. The cigarette carton assembly of claim 28, further comprising ten packages of cigarettes.

32. The cigarette carton assembly of claim 28, further comprising five packages of cigarettes.

33. The cigarette carton assembly of claim 28, wherein the dispensing portion is removable.

34. The cigarette carton assembly of claim 28, wherein the bottom edge of the first side wall and the second end edge of the first side wall intersect to form a corner and wherein a first end of the perforation line terminates at the corner where the bottom edge of the first side wall and the second end edge of the first side wall intersect.

35. The cigarette carton assembly of claim 34, wherein the bottom edge of the second side wall and the second end edge of the second side wall intersect to form a corner and wherein a first end of the score line terminates at the corner where the bottom edge of the second side wall and the second end edge of the second side wall intersect.

36. The cigarette carton assembly of claim 28, wherein the bottom edge of the second side wall and the second end edge of the second side wall intersect to form a corner and wherein a first end of the score line terminates at the corner where the bottom edge of the second side wall and the second end edge of the second side wall intersect.

37. The cigarette carton assembly of claim 28, wherein the perforation line comprises a plurality of angled cuts.

38. The cigarette carton assembly of claim 37, wherein the perforation line further comprises a tear start region on the first side wall.

39. The cigarette carton assembly of claim 28, wherein the perforation line is a zipper-type perforation line.

40. The cigarette carton assembly of claim 28, wherein the score line is semi-circular.

41. The cigarette carton assembly of claim 28, further comprising a second perforation line.

42. The cigarette carton assembly of claim 40, wherein the second perforation line is aligned with the score line.

43. The cigarette carton assembly of claim 42, wherein the score line and the second perforation line are both semi-circular.

* * * * *